US006106592A

United States Patent [19]

Paranjpe et al.

[11] Patent Number: 6,106,592

[45] Date of Patent: Aug. 22, 2000

[54] WET ELECTROSTATIC FILTRATION PROCESS AND APPARATUS FOR CLEANING A GAS STREAM

[75] Inventors: Prabhakar D. Paranjpe, Chesterfield; Lawrence F. Paschke, Bridgeton, both of Mo.

[73] Assignee: Monsanto Company, St. Louis, Mo.

[21] Appl. No.: 09/270,367

[22] Filed: Mar. 16, 1999

Related U.S. Application Data

[63] Continuation-in-part of application No. 09/040,040, Mar. 17, 1998, abandoned.

[60] Provisional application No. 60/090,460, Jun. 24, 1998.

[51] Int. Cl.[7] ..... B03C 3/014

[52] U.S. Cl. ..... 95/65; 95/68; 95/71; 96/44; 96/50; 96/53

[58] Field of Search ..... 95/64–66, 68, 95/75, 71; 96/27, 52, 53, 44–50; 55/360

[56] References Cited

U.S. PATENT DOCUMENTS

| | | | |
|---|---|---|---|
| 3,874,858 | 4/1975 | Klugman et al. | 55/118 |
| 4,003,811 | 1/1977 | Kunkle | 204/180 R |
| 4,038,049 | 7/1977 | Melcher et al. | 55/2 |
| 4,110,189 | 8/1978 | Kunkle et al. | 204/180 R |
| 4,146,371 | 3/1979 | Melcher et al. | 55/10 |
| 4,154,585 | 5/1979 | Melcher et al. | 55/99 |
| 4,194,888 | 3/1980 | Schwab et al. | 55/2 |
| 4,222,748 | 9/1980 | Argo et al. | 55/6 |
| 4,259,707 | 3/1981 | Penney | 361/212 |
| 4,351,648 | 9/1982 | Penney | 55/137 |
| 4,376,022 | 3/1983 | Porta et al. | 204/180 R |
| 4,619,670 | 10/1986 | Malcolm et al. | 55/107 |
| 4,759,835 | 7/1988 | Klinkowski | 204/182.2 |

(List continued on next page.)

FOREIGN PATENT DOCUMENTS

| | | |
|---|---|---|
| 1 098 052 | 3/1981 | Canada . |
| 2 392 723 | 12/1978 | France . |
| 431 865 | 7/1926 | Germany . |

OTHER PUBLICATIONS

International Search Report of PCT/US99/05739 dated Jun. 18, 1999 (4 pages).

Bürkholz, Armin "Droplet Separation" Ch. 4–Electrostatic Precipitators, pp. 17–25, 1989.

Derwent World Patent Index (WPI) abstract for EP–A–403895, WPI Acc. No. 90–261963/35, 1996.

Derwent World Patent Index (WPI) abstract for JP–A–7163804, WPI Acc. No. 95–260141/34, 1996.

Derwent World Patent Index (WPI) abstract for JP–A–2229531, WPI Acc. No. 90–323520/43, 1996.

Derwent World Patent Index (WPI) abstract for NL–A–8502919, WPI Acc. No. 87–175706/25, 1996.

Derwent World Patent Index (WPI) abstract for WO–A–9221433, WPI Acc. No. 92–433422/52, 1996.

Derwent World Patent Index (WPI) abstract for SU–A–1778099, WPI Acc. No. 93–402559/50, 1996.

Derwent World Patent Index (WPI) abstract for SU–A–1698708, WPI Acc. No. 92–372366/45, 1996.

Derwent World Patent Index (WPI) abstract for SU–A–881580, WPI Acc. No. 82–L9448E/36, 1996.

*Primary Examiner*—Richard L. Chiesa

*Attorney, Agent, or Firm*—Senniger, Powers, Leavitt & Roedel

[57] ABSTRACT

The present invention relates to a gas cleaning process and apparatus for removing solid and liquid aerosols entrained in a gas stream. The gas to be treated is passed through a wetted, electrostatically charged filter media. In accordance with a preferred embodiment of the present invention, the polarity of the electrostatic charge on the filter media is selected to enhance the removal of captured solid particles from the filter media. The apparatus is readily adaptable to a modular gas cleaning system configuration wherein varying numbers of the apparatus may be operated in parallel to provide a gas cleaning system of any desired gas flow capacity.

41 Claims, 6 Drawing Sheets

U.S. PATENT DOCUMENTS

| | | | |
|---|---|---|---|
| 4,861,356 | 8/1989 | Penney | 55/137 |
| 4,940,471 | 7/1990 | Penney | 55/120 |
| 5,021,136 | 6/1991 | Candor | 204/182.1 |
| 5,106,468 | 4/1992 | Chimenti | 204/180.1 |
| 5,151,198 | 9/1992 | McCullough, Jr. et al. | 210/767 |
| 5,171,409 | 12/1992 | Barnier et al. | 204/182.2 |
| 5,234,594 | 8/1993 | Tonucci et al. | 210/500.26 |
| 5,264,137 | 11/1993 | McCullough, Jr. et al. | 210/767 |
| 5,468,385 | 11/1995 | Inoue | 210/243 |
| 5,855,652 | 1/1999 | Talley | 95/75 X |

GAS OUT
7
51
37a
40a
49
49
48
48a
47a
47a
53
45a
1a
23
40b
23
9a
20
18
37
39
POWER SUPPLY
13
17
40
23
22
23
15
23
23
21
PURGE AIR
27
33
19
57
29
30
55
GAS IN
25
31
41
5
41
35

WET ELECTROSTATIC FILTRATION PROCESS AND APPARATUS FOR CLEANING A GAS STREAM

This application is a continuation-in-part application of U.S. Ser. No. 09/040,040, filed Mar. 17, 1998 (now abandoned) and also claims the benefit of U.S. provisional application Ser. No. 60/090,460, filed Jun. 24, 1998. The disclosures of these related applications are expressly incorporated herein by reference.

BACKGROUND OF THE INVENTION

The present invention relates to a gas cleaning process and apparatus for removing suspensions of solid and/or liquid particles (i.e., aerosols) entrained in a gas stream which utilizes a wetted, electrostatically charged filter media. The present invention is particularly suited for cleaning gaseous effluents emitted from various industrial installations such as incinerators, calciners, utility boilers, sulfonation operations and wood products manufacture facilities, among many others.

Electrostatic precipitation is a widely used technique for separating solid and liquid aerosols from gas streams. Electrostatic precipitators are characterized by at least one ionizing electrode (e.g., a wire, sharp-edged rod or other conducting member having a small radius of curvature) maintained at high electric potential and spaced from one or more ground or precipitating electrodes of relatively large surface area. Particles entrained in the gas to be treated are charged as the gas is forced to pass through the limited current discharge (i.e., corona) between the ionizing and precipitating electrodes. The electric field drives the charged particles to the collecting region of the apparatus where they are discharged and precipitated on the surface of the precipitating electrode.

The collecting surfaces of an electrostatic precipitator must be freed of precipitated material from time to time in order to maintain the desired collection efficiency. As the aerosol load in the gas to be treated increases, more frequent cleaning of the collecting surfaces of the precipitator is necessary. If the particles being collected are essentially dry, removal of precipitated material can be achieved by rapping or shaking the precipitating electrodes. In applications where the particles being collected are wet and/or tacky, a wet electrostatic precipitator design may be employed. In wet electrostatic precipitators, the collecting surface of the precipitating electrodes is a liquid film. The liquid film, usually aqueous, may be provided by precipitation of droplets entrained in the gas being treated and/or by irrigating the precipitating electrodes with a liquid spray. During operation, the film of liquid continuously drains from the precipitating electrodes of a wet electrostatic precipitator, thereby removing collected solids which would otherwise tend to accumulate. Although wet electrostatic precipitators are capable of achieving high collection efficiencies, even with respect to smaller (e.g., submicron) diameter particles, the associated capital and operating costs are often prohibitive.

Cloth bags, commonly referred to as baghouse filters, are used to remove solid particles entrained in dry gas streams. As dust-laden gas flows into the filter bag, entrained solids collect on the bag and clean gas passes through. Periodically, the collected material is dislodged from the bag by mechanically shaking the bag or by flexing the bag with a reverse pulse of compressed air. Baghouses are simple and relatively inexpensive to operate and can achieve high collection efficiencies. Unfortunately, baghouses are not suited for cleaning gas streams having a high liquids content and/or containing tacky solids since it is difficult to remove collected material from the bags. Moreover, in some designs, it may be necessary to interrupt the gas cleaning operation while collected material is being removed from the filter bags.

Venturi and other types of scrubbers can be used to remove liquid particles and tacky solids from gas streams. However, to achieve high collection efficiencies, especially with respect to smaller particles, high pressure drops must be used leading to increased operating cost.

Therefore, there remains a need for a system for continuous, efficient cleaning of gaseous, industrial effluents capable of achieving a high degree of removal of solid and liquid aerosols entrained in the gas.

SUMMARY OF THE INVENTION

Among the objects of the present invention, therefore, are the provision of a process and apparatus for removing solid and liquid aerosols entrained in a gas stream; the provision of such a process and apparatus in which collected solids are continuously and effectively purged so that treatment of the gas may be proceed uninterrupted; the provision of such a process and apparatus capable of achieving a high collection efficiency even under high particle loading conditions; and the provision of such a process and apparatus in which the capital and operating costs may be reduced as compared to other gas cleaning systems.

Briefly, therefore, the present invention is directed to a process for treating a gas stream to remove solid or liquid particles entrained in the gas stream. The process comprises providing a substantially electrically isolated, gas-permeable filter element comprising electrically conductive filter media wetted with a liquid. The wetted filter media is electrostatically charged by applying an electric potential to the filter media with respect to ground. The gas stream to be treated is passed through an electric field imposed by a limited current discharge between the electrostatically charged filter media and a ground electrode to induce a charge on particles entrained in the gas having a polarity opposite of the charge on the filter media. The gas stream containing charged particles is then passed through the filter element with a horizontal component of movement, the entrained particles thereby being captured in the wetted filter media to produce a clean gas stream from which entrained particles have been removed. Liquid continuously drains from the wetted filter media under the force of gravity. The draining liquid has a horizontal component of movement through the filter media toward the downstream surface of the filter element relative to the direction of gas flow through the filter element imparted by the gas drag force. As the liquid drains from the wetted filter media, it removes particles captured in the filter media and produces a liquid waste stream exiting the filter element containing the removed particles.

Solid particles captured within the wetted filter media and the liquid wetting the filter media comprise a suspension having a zeta potential characterized by a charge of the same polarity attached to the surface of a predominant number of captured solid particles within the suspension. In accordance with a preferred embodiment of the present invention, the polarity of the electric potential applied to the filter media is selected such that the filter media has a charge of the same polarity as the zeta potential of the suspension of captured solid particles in the wetted filter media. This results in captured solid particles in the suspension being repulsed from the filter media by electrophoresis and enhances removal of the captured solid particles from the wetted filter media by the draining liquid.

The invention is further directed to an apparatus for treating a gas stream to remove solid or liquid particles entrained in the gas stream and produce a clean gas stream from which particles have been removed and a liquid waste stream containing particles removed from the gas stream. The apparatus comprises a housing having an inlet for introducing the gas stream into the housing, an outlet for discharging the clean gas stream from the housing and a liquid drain port for removing the liquid waste from the housing. A substantially electrically isolated, gas-permeable filter element comprising electrically conductive filter media wetted by a liquid is disposed and oriented within the housing such that the gas stream introduced into the housing is forced to pass through the filter element with a horizontal component of movement and liquid continuously drains from the wetted filter media under the force of gravity to remove particles captured in the filter media and produce the liquid waste stream containing the removed particles. The apparatus further includes a ground electrode disposed within the housing and connected to ground, a direct current power supply and means for connecting the direct current power supply to the filter media and the ground electrode such that an electric potential is applied to the filter media with respect to ground to electrostatically charge the filter media.

In accordance with another embodiment, the gas cleaning apparatus of the present invention comprises a housing in the form of a vertical cylinder having an inlet for introducing the gas stream into the housing, an outlet for discharging the clean gas stream from the housing and a liquid drain port for removing the liquid waste from the housing. A substantially electrically isolated, gas-permeable filter element and seal leg combination is suspended within the housing. The gas-permeable filter element is in the form of a substantially vertical cylinder and comprises electrically conductive filter media wetted by a liquid and supported upon a cylindrical foraminous support. The filter element is disposed and oriented within the housing such that the gas stream introduced into the housing is forced to pass through the filter element with a horizontal component of movement to remove particles entrained in the gas stream and produce the clean gas stream and liquid continuously drains from the wetted filter media under the force of gravity to remove particles captured in the filter media and produce the liquid waste stream containing the removed particles. The seal leg comprises a liquid drain conduit and seal leg cup. The liquid waste stream is removed from the filter element through the liquid drain conduit and collects in the seal leg cup to provide a liquid seal in the liquid drain conduit and prevent the gas stream introduced into the housing from bypassing the filter media. The apparatus further comprises means for contacting the gas stream with a spray of liquid droplets upstream of the filter element relative to the direction of gas flow, a ground electrode, a direct current power supply and means for connecting the direct current power supply to the filter media and the ground electrode such that an electric potential is applied to the filter media with respect to ground to electrostatically charge the filter media. The ground electrode is connected to ground and made integral with the housing such that the interior surface of the housing serves as the ground electrode.

The invention is further directed to a modular gas cleaning system for treating a gas stream to remove solid or liquid particles entrained in the gas stream and produce a clean gas stream from which particles have been removed and a liquid waste stream containing particles removed from the gas stream. The system comprises at least one gas cleaning apparatus module comprising a housing, a substantially electrically isolated, gas-permeable filter element and seal leg combination suspended within the housing and a ground electrode. The housing is in the form of a vertical cylinder having an inlet for introducing the gas stream into the housing, an outlet for discharging the clean gas stream from the housing and a liquid drain port for removing the liquid waste from the housing. The gas-permeable filter element is in the form of a substantially vertical cylinder and comprises electrically conductive filter media wetted by a liquid and supported upon a cylindrical foraminous support. The filter element is disposed and oriented within the housing such that the gas stream introduced into the housing is forced to pass through the filter element with a horizontal component of movement to remove particles entrained in the gas stream and produce the clean gas stream and liquid continuously drains from the wetted filter media under the force of gravity to remove particles captured in the filter media and produce the liquid waste stream containing the removed particles. The seal leg comprises a liquid drain conduit and seal leg cup. The liquid waste stream is removed from the filter element through the liquid drain conduit and collects in the seal leg cup to provide a liquid seal in the liquid drain conduit and prevent the gas stream introduced into the housing from bypassing the filter media. The ground electrode is connected to ground and made integral with the housing such that the interior surface of the housing serves as the ground electrode. The system further comprises means for contacting the gas stream with a spray of liquid droplets upstream of the filter element relative to the direction of gas flow, a direct current power supply and means for connecting the direct current power supply to the filter media and the ground electrode such that an electric potential is applied to the filter media with respect to ground to electrostatically charge the filter media. An intake manifold and a clean gas manifold adapted for connection to at least one gas cleaning apparatus module are connected to the module such that the intake manifold and the clean gas manifold are in fluid communication through the module. The gas stream to be treated is introduced into the intake manifold and passed through the module and the clean gas stream from the module is discharged from the system through the clean gas manifold. The intake manifold serves as a sump for collecting liquid waste draining from the module.

Other objects and features of this invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

In accordance with the present invention, a novel gas cleaning system for separating solid and liquid aerosols from a gas stream has been devised. The gas to be treated is forced to pass through a wetted, electrostatically charged filter media. The charged filter media induces a charge of opposite polarity on particles entrained in the gas. The oppositely charged particles are attracted to the filter media, greatly enhancing the particle collection efficiency. Unlike conventional gas filtration mechanisms (e.g., sieving, impaction, interception, and diffusion), electrostatic filtration is capable of efficiently capturing particles entrained in a gas largely independent of the pore size and void fraction of the filter media. Thus, the filter media used in the practice of the present invention may be constructed so as to have a relatively open structure, combining a high collection efficiency with a low pressure drop across the apparatus. The present invention further provides for regeneration of the electrostatically charged filter media by continuous removal of the collected particles. This is achieved by wetting the filter media with a liquid film which continuously drains from the filter media under the force of gravity. The draining liquid removes captured particles from the structure of the filter media so that the pressure drop across the apparatus remains essentially constant and the gas cleaning operation may proceed uninterrupted. In accordance with a preferred embodiment of the present invention described in detail below, the polarity of the charge on the filter media is selected relative to the zeta potential exhibited by the suspension of captured solid particles in the liquid wetting the filter media to further enhance the cleaning of the filter media by electrophoresis.

Figure 1:
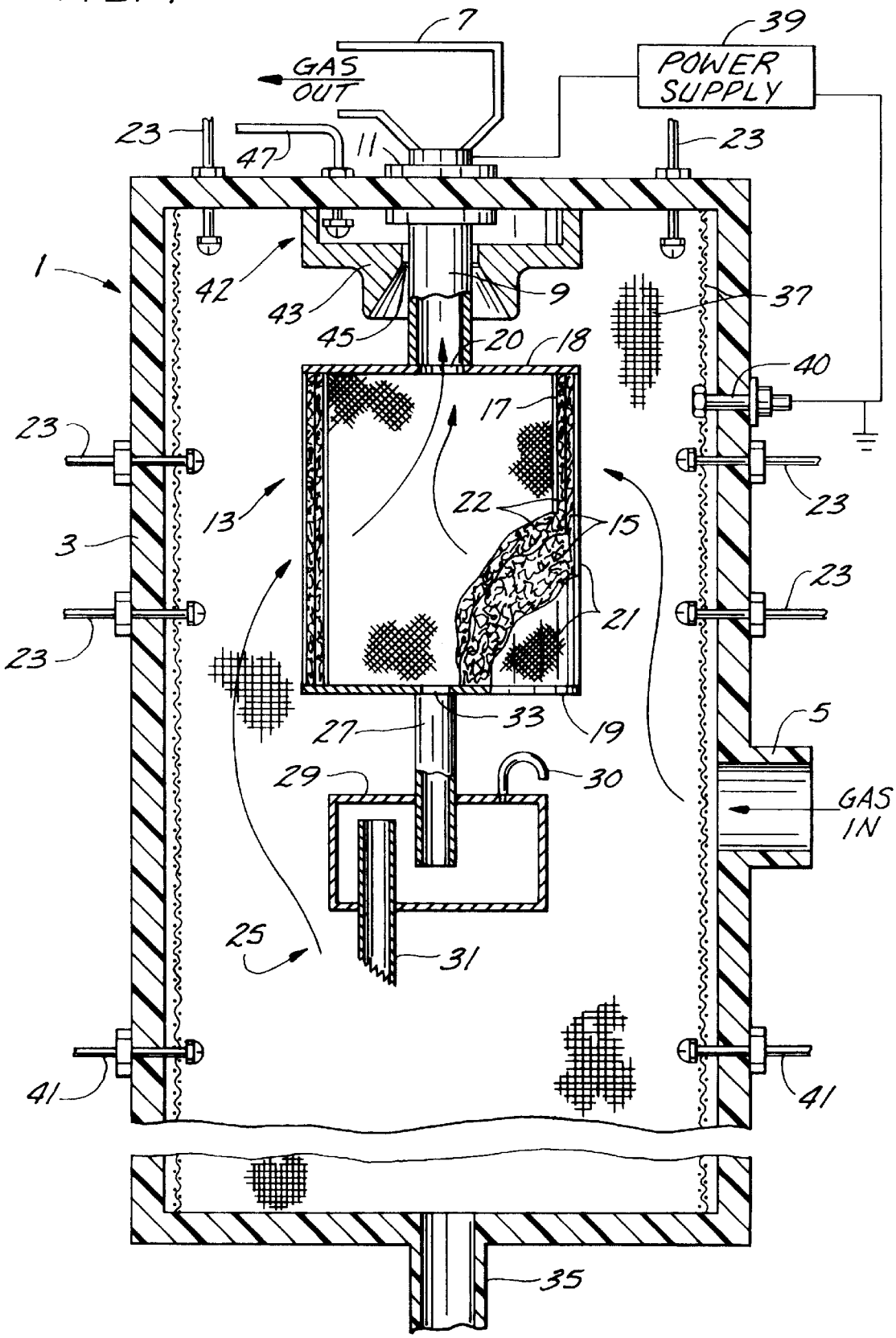
FIG. 1 is a fragmentary, longitudinal section of a gas cleaning apparatus in accordance with the present invention with portions broken away to show the internal construction thereof.

For a better understanding of the invention, reference is made to FIG. 1 which shows a fragmentary, longitudinal section of a gas cleaning apparatus in accordance with a first embodiment of the present invention with portions broken away to show the internal construction thereof.

The apparatus 1 comprises a housing 3 having an inlet port 5 for introducing the gas to be treated and an outlet port 7 through which clean, treated gas is discharged from the apparatus. The outlet port is centrally positioned on the top side of the housing and is in fluid communication with the interior of the housing through a clean gas conduit 9 extending into the housing through a fitting 11 which secures the clean gas conduit to the top side of the housing.

A gas-permeable filter element 13 is disposed and oriented within housing 3 such that the gas stream introduced into the housing is forced to pass through the filter element with a horizontal component of movement. The direction of gas flow through the housing and filter element is indicated by arrows in FIG. 1. As shown in FIG. 1, the filter element may be in the form of a substantially vertical cylinder. Filter element 13 comprises a layer of electrically conductive filter media 15 wound upon a rigid, cylindrical, foraminous support or screen 17 fastened between an upper support plate 18 and a lower support plate 19. Upper support plate 18 has a central bore 20 and filter element 13 is secured within housing 3 by joining the end of clean gas conduit 9 opposite outlet port 7 to the periphery of the bore in the upper support plate. Thus, outlet port 7 is in fluid communication with the interior of filter element 13 through clean gas conduit 9. Clean gas conduit 9, cylindrical support screen 17 and upper and lower support plates 18 and 19 are made of electrically conductive material (e.g., stainless steel) such that these components of the apparatus are electrically connected to filter media 15. In order to ensure that filter media 15 is retained on the cylindrical support and to ease handling of filter element 13, the filter element may further comprise a gas-permeable, containment mesh 21 wound around support screen 17 adjacent to the exterior (i.e., upstream) surface of the filter media. Containment mesh 21 may suitably be constructed of a non-conductive, corrosive-resistant material such as fiberglass reinforced plastic (FRP).

Woven or nonwoven metal fibers or woven fabrics comprising carbon or metal-coated polymeric (e.g., nylon) fibers may serve as electrically conductive filter media 15. An example of a suitable woven, metal-coated fabric is the product sold under the trademark FLECTRON, commercially available from Monsanto Company, St. Louis, Mo., U.S.A. In a preferred embodiment, the electrically conductive filter media comprises a non-woven stainless steel wool mat made of fibers having a diameter ranging from about 40 $\mu$m to about 500 $\mu$m. In another preferred embodiment, the electrically conductive filter media comprises a co-knit material comprising a mixture of electrically conductive (e.g. metal) and electrically insulative (e.g., polymeric) fibers. An example of such a suitable co-knit material is that commercially available from ACS Industries, Houston, Tex., U.S.A. under Catalog No. 8TMW11. This co-knit material is made from a continuous, Alloy 20 stainless steel wire having a diameter of about 280 $\mu$m and a woven TEFLON filament having a fiber diameter of about from about 15 $\mu$m to about 30 $\mu$m. In the practice of the present invention, non-woven metal fiber mats and metal and polymeric fiber co-knit materials are generally equally preferred for use as the electrically conductive filter media. However, metal and polymeric fiber co-knit material may offer pressure drop advantages over metal fiber mats, especially when fine fiber diameters are required to achieve the desired particle collection efficiency, and are generally more preferred in corrosive environments (e.g., treatment of acid mist-containing effluents) where a material cost advantage may be realized as compared to a filter media comprised solely of non-woven, corrosion-resistant, high alloy metal fibers.

Although the present invention is not limited to a particular theory, the ability of a co-knit material comprising electrically conductive and electrically insulative polymeric (e.g., TEFLON, nylon, etc.) fibers to function effectively despite the presence of electrically insulative material is perhaps explained by the fact that during operation of the gas cleaning apparatus, the filter media remains wetted by a liquid film which continuously drains from the wetted filter media under force of gravity. Although it is well-known that polymeric materials such as TEFLON are generally excellent electrical insulators under dry conditions, under the wetted conditions present during practice of the present invention, the surface of the polymeric fibers is believed to be electrostatically charged and at the same applied voltage as the surface of the electrically conductive fiber present in the co-knit material. Therefore, the electrophoresis mechanism described in detail below by which captured solid particles are repulsed from the surface of the filter media would also assist in cleaning the polymeric fibers. In any event, electrically conductive filter media as used herein should be understood to include filter media comprised in whole or in part of electrically insulative materials which are rendered sufficiently conductive upon being wetted during operation of the apparatus in accordance with the present invention. Although it is possible to practice this invention where the filter media consists solely of electrically insulative material, it is preferred that the filter media include at least some electrically conductive material.

Since the collection efficiency of the apparatus is significantly enhanced by electrostatically charging the filter media, a dense, tightly constructed filter media may not be necessary to achieve the desired collection efficiency. Preferably, in order to reduce the pressure drop across the filter, the electrically conductive filter media is relatively thin and has an open, porous structure. For example, where a non-woven stainless steel wool mat is used as the electrically conductive filter media, suitable results are achieved if the stainless steel wool mat is from about 2.5 cm to about 5 cm thick and exhibits a void fraction of at least about 80 percent, more preferably at least about 94 percent. By void fraction, it is meant the difference between 1 and the ratio of the bulk density of the electrically conductive filter media to the density of the material (e.g., stainless steel fibers) used to form the filter media.

The filter element may also include means for controlling reentrainment of draining liquid and solid particles captured in filter media 15 by the clean gas stream exiting the interior surface of the filter element. Use of reentrainment control means will be necessary in most applications in order to minimize the capital costs. As shown in FIG. 1, the reentrainment control means may comprise a gas-permeable layer of fibrous material 22 wound around support screen 17 adjacent to the interior (i.e., downstream) surface of the filter media. Fibrous reentrainment control media are well known in the mist eliminator art and will typically have an increased fiber diameter and void fraction relative to the electrically conductive filter media. An example of a fibrous material suitable for use as a reentrainment control layer is the wiremesh demister pads commercially available from ACS Industries, Houston, Tex., U.S.A. This product is made from knitted stainless steel wire having a diameter ranging from about 250 $\mu$m to about 300 $\mu$m in corrugated profiles. Suitable reentrainment control media can be constructed from successive layers of this product to obtain a layer of the desired thickness, typically 0.5 cm to 2.5 cm.

During operation of the apparatus, filter media 15 is wetted by a liquid film which continuously drains from the wetted filter media under force of gravity. The draining liquid removes particles captured in the filter media as part of a liquid waste stream. The filter media may be wetted by droplets of liquid entrained in the gas to be treated which are subsequently captured in the filter media as the gas flows through the filter element. Typically, however, the gas to be treated will not have a liquid loading at its source sufficient to ensure adequate irrigation of the filter element. Thus, in order to increase the liquid loading of the gas prior to entering the filter element, the apparatus may include means for contacting the gas to be treated with a liquid upstream of the filter element relative to the direction of gas flow. For example, the gas may be contacted with a spray of liquid droplets or other gas-liquid contacting apparatus may be used. As shown in FIG. 1, such gas-liquid contacting means may comprise one or more fogging nozzles 23 extending through the sides of housing 3 and in selective fluid communication with a source of liquid (not shown). Fogging nozzles 23 inject liquid into the housing in the form of a dense fog of droplets and may be of any suitable design, including single fluid high pressure nozzles or air atomized nozzles. For reasons of economy, the liquid supplied to the nozzles for injection into the housing preferably comprises water such that the filter element is irrigated with an aqueous liquid. In order to facilitate subsequent capture and removal of the liquid droplets in the filter media, it is preferred that the liquid spray generated by nozzles 23 have a mean droplet diameter greater than about 20 $\mu$m. Although it is preferred, the gas to be treated need not be contacted with a liquid spray upstream of the filter element. Thus, rather than being wetted by droplets of liquid removed from the gas to be treated, the filter media may be wetted directly.

It should be noted that the electrostatically charged filter media will induce an opposite charge on liquid droplets issuing from the fogging nozzles as the droplets entrained in the gas to be treated approach the filter media. Thus, like solid and liquid particles present in the gas to be treated at its source, charged liquid droplets entrained in the gas will be attracted to the filter media, greatly enhancing the wetting of the filter media and removal of captured particles by the liquid phase draining from the filter element. It is believed that the electrostatically charged filter media increases the impingement of liquid droplets entrained in the gas to be treated and creates a tightly bonded liquid film enveloping the surfaces of the filter media. As a result, solid particles entrained in the gas to be treated cannot easily break this liquid barrier and contact the fiber surface. In this fashion, the electrostatically charged filter media improves wetting and cleaning of the filter media and decreases plugging problems.

A conventional liquid seal leg 25 for allowing liquid waste drained from the filter media to be removed from the filter element without permitting untreated gas to bypass the filter media is secured to lower support plate 19. The seal leg comprises a liquid drain conduit 27 and a seal leg cup 29 provided with a vent 30 and an overflow pipe 31 through which the interior of the cup is in fluid communication with the interior of housing 3. Lower support plate 19 has a central bore 33 and the upper end of liquid drain conduit 27 is joined to the periphery of the bore in the lower support plate. The lower end of the liquid drain conduit extends into seal leg cup 29 which in turn is secured to the liquid drain conduit. Thus, the entire filter element and seal leg combination are suspended within housing from clean gas conduit 9. Liquid waste drains from filter element 13 through liquid drain conduit 27 and collects in seal leg cup 29, providing a liquid seal in the liquid drain conduit which prevents incoming gas from bypassing the filter media. Liquid waste overflows the seal leg cup through overflow pipe 31 and is removed from the apparatus through a liquid drain port 35 in the bottom of the housing. In order to prevent untreated gas from exiting the housing through liquid drain port 35, a conventional liquid level controller may be used to maintain a quantity of liquid in the bottom of housing 3 which serves as a sump and provides a liquid seal.

The apparatus further comprises a ground electrode 37 disposed within the housing and a high voltage, direct current power supply 39. The ground electrode is comprised of electrically conductive material and, as shown in FIG. 1, may comprise a metal screen fixed adjacent to the interior surface of the lateral sides of housing 3. Preferably, in order to provide a more uniform voltage gradient and electric field, ground electrode 37 is at least substantially coextensive with the surface of the electrically conductive filter media and their respective surfaces are uniformly spaced.

The apparatus further includes means for connecting direct current power supply 39 to filter media 15 and ground electrode 37 such that an electric potential is applied to the filter media with respect to ground to electrostatically charge the filter media. The ground electrode is connected to ground and to one terminal (positive or negative) of the power supply (i.e., the ground electrode is connected to the grounded terminal of the power supply). In practice, an earth ground will usually be employed, although it is not necessary. As shown in FIG. 1, the electrical connection between the ground electrode and the power supply may be provided by one or more electrically conductive connectors or lugs 40 extending through the lateral side of housing 3 and contacting the ground electrode. The other terminal of the power supply is connected to clean gas conduit 9 such that an electric potential may be applied to filter media 15 with respect to ground. Although clean gas conduit 9, cylindrical support screen 17 and upper and lower support plates 18 and 19 were previously described as being made of metal or other electrically conductive material, it should be understood that all that is required is an electrical connection (i.e., electrical continuity) between power supply 39 and filter media 15 and that it is not necessary that all of these components be made of electrically conductive material. For example, in the embodiment shown in FIG. 1, so long as clean gas conduit 9 and upper support plate 18 are made of electrically conductive material and filter media 15 is in contact with the upper support plate, it is not necessary that lower support plate 19 and support screen 17 be constructed of electrically conductive material. Instead, these components may be made of FRP or other cost effective materials.

Power supply 39 is similar to that used in electrostatic precipitators and includes low direct current automatic voltage control means. As described in greater detail below, the filter media and the ground electrode may function as either cathode or anode in the practice of the present invention. Accordingly, the power supply control circuitry preferably allows the polarity of the electric potential applied to the filter media to be selectively reversed from positive to negative and vice versa without having to disconnect the filter media from the power supply.

The filter element and seal leg combination 13 and 25 suspended within housing 3 is substantially electrically isolated (i.e., isolated from ground) so that when the power supply is energized during operation of the apparatus, the filter media becomes electrostatically charged. Thus, housing 3, outlet port 7 and fitting 11 are constructed of electrically insulative materials and the entire filter element and seal leg combination is sufficiently separated from grounded, electrically conductive elements of the apparatus to inhibit excessive spark over under design operating conditions. Furthermore, all components of the apparatus within the housing (e.g., upper support plate 18 and a lower support plate 19) should be substantially free of protrusions, overhang and sharp edges which might tend to undermine the electrical isolation of the filter element and seal leg combination 13 and 25. Because draining liquid exiting overflow pipe 31 and flowing as a continuous stream to the bottom of housing 3 would compromise the electrical isolation of the filter element and seal leg combination by providing an electrical connection to ground, care must be taken to maintain sufficient discontinuity in this flow. This is achieved in part by the distance separating the exit end of overflow pipe 31 from the liquid level in the bottom of housing 3. Also, the periphery of the exit end of the overflow pipe may be serrated as shown in FIG. 1 so that liquid passes from the overflow pipe at a multiplicity of alternate drip points. The dimensions of the overflow pipe and the geometry and linear density of the serrations is preferably sufficient such that the liquid drain rate per drip point is no more than about 0.38 l/min., more preferably, no more than about 0.19 l/min. at the maximum design filter element irrigation rate. To further inhibit the potential for draining liquid exiting overflow pipe 31 from undermining the electrical isolation of the filter element and seal leg combination, the apparatus shown in FIG. 1 may further include one or more high velocity nozzles 41 extending through the sides of housing 3 at an elevation below the exit end of overflow pipe 31. High velocity nozzles 41 are in selective fluid communication with a pressurized source (not shown) of gas (e.g., air) or liquid (e.g., water) and are used to inject a high velocity spray of gas or liquid into the housing that intersects and disrupts the flow of liquid leaving the drip points about the periphery of the exit end of overflow pipe 31. Because extremely large volumes of gas may be required to create the momentum required to sufficiently disrupt the flow of liquid exiting the overflow pipe, high pressure nozzles 41 are preferably supplied with a liquid such as water. For example, two high pressure nozzles 41 which emit a flat, 80° spray of water (e.g., 15 l/min. at 275 kilopascals (kPa) absolute) in a plane perpendicular to the flow of liquid exiting overflow pipe 31 may be disposed on opposite sides of housing 3. High pressure nozzles 41 may be operated continuously or in intermittent fashion coincident with increased filter element irrigation when the liquid flow rate exiting overflow pipe 31 is increased.

To further ensure electrical isolation of the filter element and seal leg combination 13 and 25, the apparatus of the present invention preferably further includes means for introducing a purge gas into defined spaces or gaps separating the filter element and seal leg combination from grounded elements of the apparatus so as to inhibit excessive spark over which might otherwise result due to electrically conductive material being deposited on surfaces within the apparatus during operation. In addition, by introducing purge gas into these gaps, the size of the separation necessary to sufficiently inhibit spark over at the desired maximum design voltage may be reduced, along with the overall dimensions of the apparatus.

As shown in FIG. 1, a purge gas box 42 is joined to the interior of the top side of housing 3 in coaxial relationship with clean gas conduit 9. The purge gas box is made of electrically insulative material and has an annular lower portion 43 through which the clean gas conduit extends. The lower portion of the purge gas box is sized so that it is separated from the exterior of the clean gas conduit by an annular gap 45. A purge gas nozzle 47 extends through the top side of the housing into purge gas box 42 and is in selective fluid communication with a pressurized supply of clean, dry, air or other purge gas (not shown). Preferably, atmospheric air introduced as purge gas into the apparatus of the present invention is first filtered to remove contaminants and heated to raise its dew point sufficiently to avoid condensation on surfaces within the apparatus. Purge gas introduced into purge gas box 42 passes through annular gap 45 and exits the apparatus through filter element 13. The flow of purge gas through the annular gap inhibits electrically conductive material entrained in the untreated gas (e.g., water droplets and soluble and insoluble solids) from depositing on surfaces within the purge gas box and the surfaces defining the annular gap. Such coatings would tend to undermine the electrical isolation of the filter element and seal leg combination by providing an electrical connection to ground. The volumetric flow rate of purge gas introduced into purge gas box 42 should be selected relative to the cross-sectional area of annular gap 45 so that purge gas flows through the gap at a velocity adequate to prevent deposition of electrically conductive material entrained in the untreated gas sufficient to cause excessive spark over under design operating conditions.

It should be understood that substantial electrical isolation of the filter element and the high voltage connection thereto may be suitably achieved using other designs and techniques of the type used by those skilled in the art of electrostatic precipitators. An example of one such alternative design is shown in FIG. 2.

Figure 2:
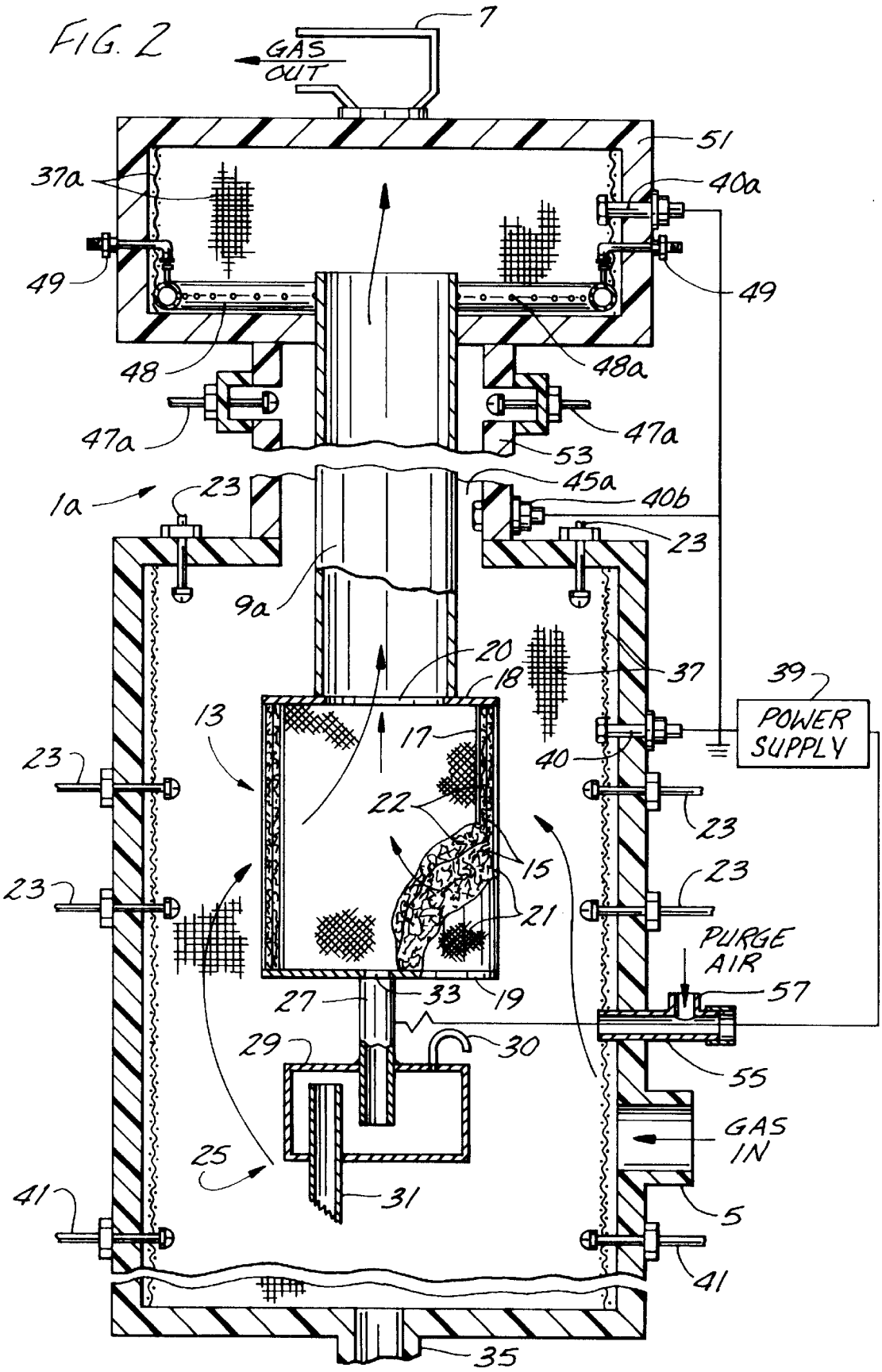
FIG. 2 is a fragmentary, longitudinal section of a gas cleaning apparatus in accordance with another embodiment of the present invention with portions broken away to show the internal construction thereof.

FIG. 2 is a fragmentary, longitudinal section of a gas cleaning apparatus 1a in accordance with another embodiment of the present invention with portions broken away to show the internal construction thereof. The direction of gas flow through the apparatus is indicated by arrows in FIG. 2. Unless otherwise noted herein, gas cleaning apparatus 1*a* shown in FIG. 2 is substantially similar to apparatus 1 described above and shown in FIG. 1. The design shown in FIG. 2 is believed to be more representative of an apparatus that can be adapted to commercial application of the present invention.

In FIG. 2, filter element and seal leg combination 13 and 25 are suspended within housing 3 from clean gas conduit 9*a* which in turn extends into and threadedly engages or is otherwise secured to the bottom of a clean gas box 51. Thus, clean gas exiting the filter element flows through the clean gas conduit into the clean gas box and is discharged through outlet port 7. A tubular metal jacket 53 surrounds the clean gas conduit in coaxial relationship therewith and supports clean gas box 51 above housing 3. The interior of jacket 53 is separated from the exterior of clean gas conduit 9*a* by an annular gap 45*a*. A ground electrode 37*a* is disposed within clean gas box 51. Like ground electrode 37 disposed within housing 3, ground electrode 37*a* is comprised of electrically conductive material and, as shown in FIG. 2, may comprise a metal screen fixed adjacent to the interior surface of the lateral sides of the clean gas box.

An electrical connection between one terminal of direct current power supply 39 and the electrically conductive filter media 15 is provided through liquid drain conduit 27 of seal leg 25 via a high voltage feed through design of the type conventionally employed in electrostatic precipitators. As shown in FIG. 2, this includes a conduit 55 made of electrically insulative material and extending into housing 3 adjacent the seal leg. The high voltage lead from power supply 39 passes through conduit 55 and is connected to liquid drain conduit 27. Liquid drain conduit 27 and lower support plate 19 are made of electrically conductive material (e.g., stainless steel) such that these components of the apparatus are electrically connected to filter media 15. Ground electrodes 37 and 37*a* and jacket 53 are connected to the grounded terminal (positive or negative) of power supply 39. As shown in FIG. 2, the electrical connection between the grounded terminal of the power supply and ground electrode 37*a* is provided by one or more electrically conductive lugs 40*a* extending through the lateral side of clean gas box 51 and contacting the ground electrode. Similarly, jacket 53 is connected to the grounded terminal of the power supply by an electrically conductive lug 40*b*.

The filter element and seal leg combination 13 and 25 suspended within housing 3 is substantially electrically isolated from ground so that when the power supply is energized during operation of the apparatus, the filter media becomes electrostatically charged. Thus, in this embodiment, housing 3, clean gas conduit 9*a* and clean gas box 51 are constructed of electrically insulative materials and the entire filter element and seal leg combination is sufficiently separated from grounded, electrically conductive elements of the apparatus to inhibit excessive spark over under design operating conditions as described above. In addition, purge gas nozzles 47*a* in selective fluid communication with a pressurized supply of filtered, heated air or other purge gas (not shown) extend through jacket 53 and are directed into gap 45*a*. Multiple purge gas nozzles 47*a* at the same elevation may be positioned at 90° increments about jacket 53. Purge gas introduced into gap 45*a* inhibits electrically conductive material entrained in the untreated gas from depositing on the interior surface of jacket 53 and the exterior surface of clean gas conduit 9*a* which might otherwise cause spark over between these two components at an applied voltage lower than the desired maximum design voltage. The volumetric flow rate of purge gas introduced into jacket 53 should be selected relative to the cross-sectional area of annular gap 45*a* so that purge gas flows through the gap at a velocity adequate to prevent deposition of electrically conductive material entrained in the untreated gas sufficient to cause excessive spark over under design operating conditions. The velocity of the purge gas through annular gap 45*a* necessary to avoid excessive spark over will generally decrease as the size of the gap increases and also depends on other factors as well such as the composition of the purge gas. Typically, the velocity of purge gas through annular gap 45*a* should be at least about 0.05 m/s.

There is also a purge gas annulus 48 positioned adjacent the bottom interior surface of clean gas box 51. The purge gas annulus is of hollow tubular construction and is also in selective fluid communication with a pressurized supply of purge gas (not shown) via couplings 49. The purge gas annulus has a multiplicity of holes 48*a* spaced about its internal diameter. Purge gas introduced into purge gas annulus 48 flows out through the multiplicity of holes 48*a* and over the interior surface of the bottom of clean gas box 51 and the surfaces of clean gas conduit 9*a* extending into the clean gas box to inhibit electrically conductive material entrained in the treated gas from depositing on these surfaces. Likewise, the volumetric flow rate of purge gas introduced into annulus 48 should be selected relative to the total gas flow area provided by holes 48*a* so that purge gas flows through the holes at a velocity adequate to prevent deposition of electrically conductive material entrained in the untreated gas sufficient to cause excessive spark over under design operating conditions. Conduit 55 is provided with a purge gas port 57 through which filtered, heated air or other purge gas is introduced from a pressurized source (not shown) into conduit 55. In a similar fashion, purge gas is introduced into conduit 55 at a rate sufficient to prevent excessive spark over from the high voltage lead connected to liquid drain conduit 27 as it enters housing 3.

The process in accordance with the present invention is now described in detail with reference to the apparatus 1 and 1*a* shown in FIGS. 1 and 2, respectively.

Fogging nozzles 23 are activated to introduce an aqueous liquid into housing 3 in the form of a dense fog and the flow of purge gas from purge gas nozzles 47 and 47*a* through annular gaps 45 and 45*a* is started. In apparatus 1*a* shown in FIG. 2, the flow of purge gas from annulus 48 into clean gas box 51 and through purge gas port 57 into conduit 55 is also initiated. Power supply 39 is energized such that a high voltage electric potential (positive or negative) is applied to filter media 15 of the substantially electrically isolated filter element 13. This results in the filter media becoming electrostatically charged. A limited direct current discharge between the electrostatically charged filter element 15 and ground electrode 37 imposes an electric field between these two elements of the apparatus.

The gas to be treated is introduced into housing 3 through inlet port 5 and is contacted by the aqueous fog injected into the housing by the fogging nozzles. Liquid droplets and solid particles entrained in the wetted gas pass through the imposed electric field as the gas drag forces drive the particles toward filter element 13. The electric field induces a charge on the entrained particles of opposite polarity with respect to the charge on filter media 15. As the gas enters the filter element and flows through the electrostatically charged filter media, the charged particles are separated from the gas stream by conventional gas filtration mechanisms (e.g., sieving, impaction, interception, and diffusion) in addition to being electrostatically attracted to the surface of the oppositely charged filter media. This electrostatic attraction contributes significantly to the collection of all particles regardless of size, but is especially beneficial in the capture of submicron particles which may tend to evade separation by conventional filtration mechanisms.

Captured liquid droplets wet filter media 15 with an aqueous liquid film. The captured liquid continuously drains through the structure of the wetted filter media under the force of gravity. Gas drag forces exerted by the gas as it passes through filter element 13 impart a horizontal component of movement to the draining liquid toward the downstream surface of the filter media. As the liquid drains through the filter media, it removes captured solid particles and produces a liquid waste stream containing the removed particles which collects on lower support plate 19 and exits the filter element through the seal leg 25 before eventually being discharged from the apparatus through liquid drain port 35. The liquid waste may be recirculated and introduced again into housing 3 through fogging nozzles 23. In order to control the solids content of the recirculating water, appropriate purge and clean make-up water streams may be employed. Preferably, the solids content of the recirculating water is maintained no higher than about 5 g/l, more preferably no higher than about 1 g/l.

Clean gas, substantially free of entrained particles flows from the interior of the filter element through clean gas conduit 9 and 9*a* and exits housing 3 through outlet port 7. It has been observed that any particles remaining in the cleaned gas stream exiting the apparatus in accordance with the present invention are extremely highly charged, having a polarity which is the same as that of the electrostatic charge on filter element 13. The mechanism behind this charging effect is not fully understood.

Depending on the design criteria, the magnitude of the electric potential applied to filter media 15 may vary considerably. Generally, the higher the electric potential applied to the filter media the greater the improvement in particle collection efficiency realized. In order to maximize the beneficial effects of electrostatic attraction on the particle collection efficiency, power supply 39 preferably remains energized throughout the gas cleaning process such that an electric potential is applied to the filter media continuously. Preferably, the applied voltage is substantially maintained at a magnitude just below that which would result in spark over between the substantially electrically isolated filter element and seal leg combination 13 and 25 and the grounded elements of the apparatus at the prevailing operating conditions within the apparatus. This preferred mode of operation is readily achieved using automatic voltage control means of the type conventionally employed in power supplies associated with electrostatic precipitators. The operating range for the applied voltage controlled in this fashion will vary from application to application depending on a variety of factors such as the size and geometry of the filter element, materials of construction, the composition of the gas within the housing, the distance separating the filter element and seal leg combination from grounded elements of the apparatus as well as other factors contributing to the electrical isolation of the filter element and seal leg combination. In some applications, the electric potential applied to the filter media may be maintained no higher than about 0.5 kilovolt (kv) and suitable results achieved. However, in most applications, it will be preferred to construct and operate the apparatus in accordance with the present invention such that the electric potential applied to the filter media is maintained at a much higher magnitude. Typically, the magnitude of the electric potential applied to the filter media will be at least about 10 kv, preferably from at least about 10 kv to about 70 kv, more preferably from at least about 20 kv to about 50 kv. The average voltage gradient at the upstream surface of the filter media will typically range from about 0.8 kv/cm to about 8.0 kv/cm, more preferably from about 2.0 kv/cm to about 4.0 kv/cm. Although an electric potential is preferably applied to the filter media throughout the gas cleaning process, it is also possible to apply the electric potential intermittently.

As noted above a limited direct current discharge between the electrostatically charged filter element and the ground electrode imposes an electric field between these two elements of the apparatus. However, it should be understood that compared to conventional wet electrostatic precipitators, the operating current of the present apparatus is extremely low. That is, due to the substantial radius of curvature of the filter element 13, it functions as an essentially non-emitting surface. Typically, the current density per unit of gas flow area of the filter element will be no greater than about 10 $MA/m^2$, more preferably no greater than about 2 $MA/M^2$. It is believed that in larger scale units (e.g., having a gas flow capacity of about 60 $m^3$/min. or more) in accordance with the present invention, high particle collection efficiencies and low pressure drops can be maintained with average electrical power requirements associated with electrostatically charging the filter element typically ranging from about 20 watts to about 500 watts.

Fogging nozzles 23 may be operated continuously throughout the gas cleaning process or intermittently. The filter element irrigation rate necessary for satisfactory operation of the apparatus will vary from one application to another and can be readily determined. Typically, build-up of collected insoluble material within electrically conductive filter media 15 can be sufficiently inhibited and a steady state pressure drop across filter element 13 achieved by operating the fogging nozzles so that the average filter element irrigation rate per unit of gas flow area is from about 0.40 $l/min./m^2$ to about 4.0 $l/min./m^2$. In accordance with a preferred mode, the fogging nozzles are operated such that during large portions of the process, the filter element is irrigated at a rate less than the minimum necessary to prevent build-up of collected insoluble material in the electrically conductive filter media. Then, at intervals depending on the extent to which the filter media has become clogged, as indicated by an increase in pressure drop across the filter element, the rate at which the filter element is irrigated is increased for a relatively short period of time to flush collected solid particles and regenerate the filter media. The flow of liquid introduced into the housing by the fogging nozzles may be reduced during periods of low filter element irrigation or the nozzles may be turned completely off. Operating the fogging nozzles in this manner conserves the energy necessary to pump the liquid supplied to the fogging nozzles and may also allow the operating voltage applied to filter element 13 to be maintained at a higher value during periods of low filter irrigation due to the decreased conductivity of the gas within the housing.

In accordance with a preferred embodiment of the present invention, the polarity of the electrostatic charge on the filter media is selected to enhance the removal of captured solid particles from the wetted filter media.

In the practice of the present invention, insoluble solid particles captured in the filter media are more or less dispersed in the liquid wetting and draining from filter media 15. When an insoluble solid particle is contacted with a liquid medium, as in this suspension of captured particles, an electric double layer is formed at the solid-liquid interface comprising an array of either positive or negative electric charges attached to or adsorbed on the surface of the particle and a diffuse layer of charges of opposite sign surrounding the charged surface of the particle and extending into the liquid phase. The electrokinetic potential across the double layer is known as the zeta potential. Although the polarity of the zeta potential may change from one captured particle to another within the suspension, the polarity of the zeta potential for the suspension as a whole is characterized by the polarity of the surface charge attached to a predominant number of captured solid particles within the suspension. That is, a majority of the insoluble particles in the suspension will have either a positive or negative surface charge.

Both the magnitude and polarity of the zeta potential for the suspension of solid particles captured in the filter media will vary from application to application depending on the composition of the captured particles and the liquid wetting the filter media, as well as other factors, including the particle size distribution and the temperature and pH of the suspension. Aqueous suspensions of metallic hydroxides and hydrated oxides and basic dyestuffs tend to exhibit positive zeta potentials (i.e., a positive surface charge is attached to the solid particles), while aqueous suspensions of metals, sulfur compounds, acidic hydroxides and acidic dyestuffs tend to exhibit a negative zeta potential (i.e., a negative surface charge is attached to the solid particles). The magnitude and polarity of the zeta potential for a suspension of solid particles in a liquid medium is calculated from the electrophoretic mobilities (i.e., the rates at which solid particles travel between charged electrodes placed in the suspension) and can be readily determined using commercially available microelectrophoresis apparatus.

In the practice of the preferred embodiment, the polarity of the electric potential applied to filter media 15 is selected such that the electrically conductive material has a charge of the same polarity as the charge attached to the surface of a predominant number of solid particles captured in the wetted filter media. Thus, the charge on the electrically conductive material preferably has the same polarity as the zeta potential for the suspension of captured solid particles draining from the filter media. During operation, this results in a predominant number of captured solid particles being repulsed from the surface of the filter media by electrophoresis and advantageously allows the liquid phase of the suspension draining through the structure of the filter media to more easily remove these insoluble particles from the filter media.

In this preferred embodiment, the polarity of the electric potential to be applied to the filter media may be determined by preparing and determining the zeta potential of a solid-liquid mixture representative of the suspension of insoluble particles that will be present in the wetted filter media at the prevailing operating conditions. That is, the electric potential applied to the filter media is selected such that the charge on the electrically conductive material has the same polarity as the surface charge attached to a predominant number of the solid particles within the representative system.

In some applications, it may be advantageous to periodically switch the polarity of the electric potential applied to filter media 15 such that the charge on the electrically conductive material alternates between positive and negative. That is, the control means of direct current power supply 39 is used to switch the function of the filter media 15 and ground electrode 37 from cathode and anode to anode and cathode, respectively, and vice versa. Periodically switching the polarity of the electric potential applied to the filter media will cause both solid particles having a positive surface charge and solid particles having a negative surface charge to be alternately repulsed from the wetted filter media and thereby enhance the overall removal of captured solid particles from the filter media by the draining liquid phase. Alternating the polarity of the electric potential applied to the filter media may be especially advantageous in applications where the suspension of captured solid particles in the filter media contains a high proportion (e.g., from about 30 percent to about 70 percent) of both solid particles having a positive surface charge and solid particles having a negative surface charge. In such applications, the period during which the charge on the filter media is of a selected polarity, either positive or negative, is preferably proportional to the fraction of captured solid particles in the suspension having a charge of the same polarity attached to the surface of the particle. For example, if 60 percent of the captured solid particles in the suspension have a positive surface charge and the remainder have a negative surface charge, the period during which the filter media is positively charged is preferably about 50 percent longer than the period during which the filter media is negatively charged.

Although a preferred embodiment has been described in which the polarity of the charge on the filter media is selected to have the same polarity as the zeta potential of the suspension of captured solid particles draining from the filter media, it should be understood that satisfactory results may be achieved by the present invention even in the absence of this preferred mode of operation. However, in those applications where the preferred mode of operation is not employed (i.e., the polarity of the charge applied to the filter media is opposite of the polarity of the zeta potential for the suspension of captured solid particles), it may be necessary to increase the rate at which the filter element is irrigated to adequately flush collected insoluble material and regenerate the filter media.

Figure 3:
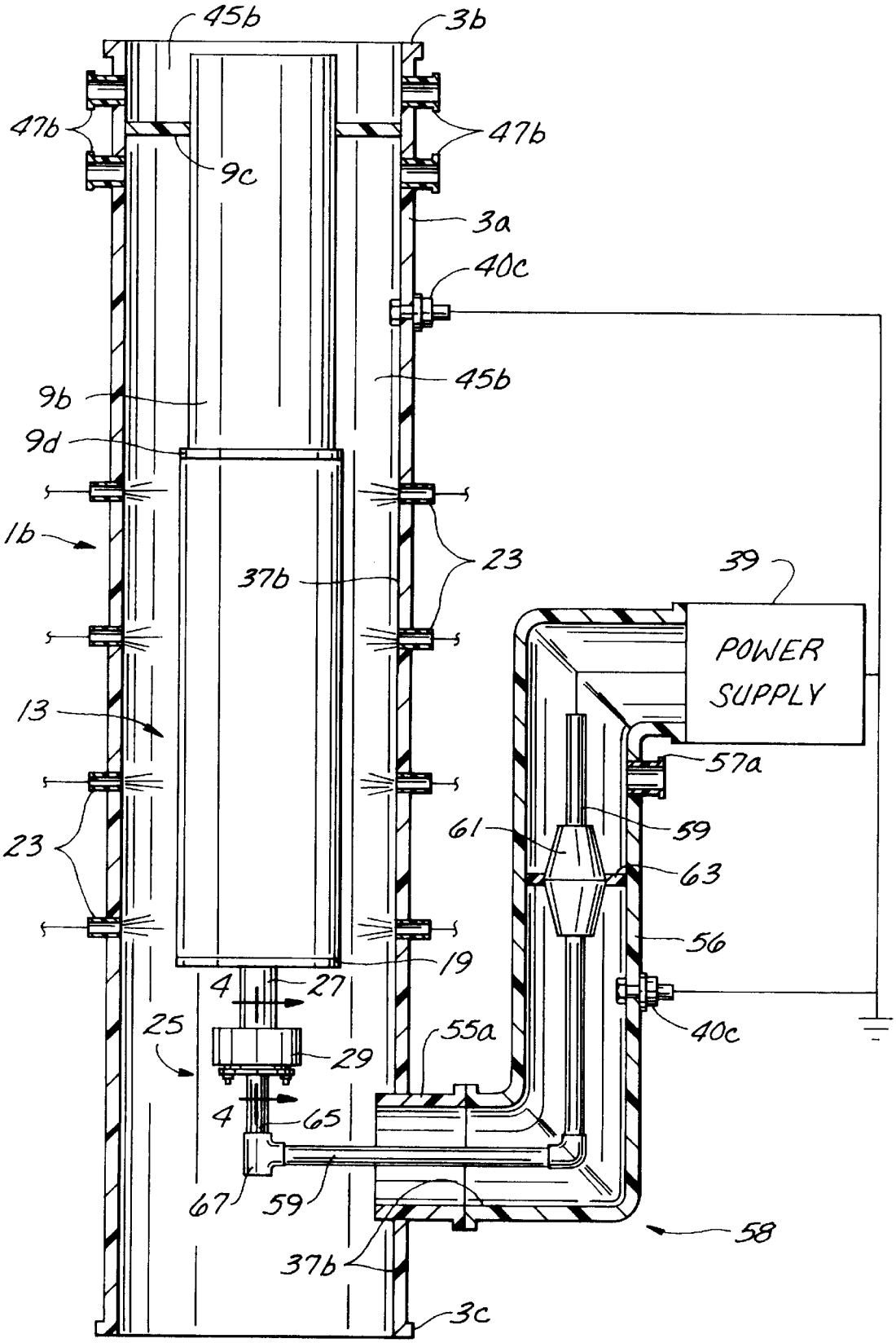
FIG. 3 is a longitudinal section of a gas cleaning apparatus in accordance with another embodiment of the present invention.

FIG. 3 is a longitudinal section of a gas cleaning apparatus 1*b* in accordance with a further alternative embodiment of the present invention. This design is believed to be especially representative of a commercial adaptation of the apparatus of the present invention. The operation and various components of this further embodiment are substantially similar to that already described with respect to the apparatus 1 and 1*a* shown in FIGS. 1 and 2, respectively. Accordingly, the significant differences are emphasized in the following description, it being understood that apparatus 1*b*, the function of its components and operation thereof are otherwise in accord with the preceding description.

In FIG. 3, housing 3*a* comprises a vertical cylinder of circular cross-section open at top and bottom flanged ends 3*b* and 3*c*, respectively. The filter element and seal leg combination 13 and 25 are suspended within housing 3*a* from clean gas conduit 9*b*. Clean gas conduit 9*b* has an upper flange 9*c* and a lower flange 9d and is suitably made of electrically insulative, corrosion-resistant material such as FRP. Upper flange 9*c* is fixed at its periphery to the interior surface of housing 3*a* and lower flange 9*d* is joined to filter element 13. The clean gas conduit, filter element and seal leg assembly 9*b*, 13 and 25 is in coaxial relationship with cylindrical housing 3*a* such that an annular gap 45*b* separates the interior surface of the housing from the exterior surface of the clean gas conduit both above and below upper flange 9*c*. The bottom end 3*c* of housing 3*a* serves as an inlet for introducing the gas to be treated into the housing. Gas introduced into the housing flows upwardly and through filter element 13. Clean gas exiting the filter element flows through clean gas conduit 9*b* before being discharged from top end 3*b* of the housing which serves as a clean gas outlet. The bottom end 3*c* of housing 3*a* also serves as a liquid drain port through which liquid waste draining from seal leg 25 is removed from the housing.

In the embodiment shown in FIG. 3, the ground electrode 37*b* is made integral with the housing. More specifically, the interior surface of housing 3*a* is made of a sufficiently electrically conductive, corrosion-resistant material and serves as the ground electrode. For example, ground electrode 37*b* may be made integral with housing 3*a* by constructing the housing from an electrically insulative, corrosion-resistant material such as FRP and lining its interior surface with a layer of static dissipative plastic. A ground electrode comprising a static dissipative plastic coating may be formed by lining the interior of the housing with a carbon fiber or graphite veil and depositing thereon a plastic resin having a high (e.g., 10–30% by weight) particulate metal (e.g., graphite) content. The resistivity of the interior surface of housing 3*a* which serves as ground electrode 37*b* should be no more than about $1\times10^4$ ohm.cm, more preferably no more than about $1\times10^3$ ohm.cm. Static dissipative plastic coatings on FRP of the type used in the practice of the present invention are well-known in the field of electrostatic precipitators and can be manufactured by Cortol Process Systems, Inc., Hazelwood, Mo., U.S.A.

An electrical connection between one terminal of direct current power supply 39 and filter element 13 is provided through seal leg 25 via a high voltage feed through design similar to that shown in FIG. 2. As shown in FIG. 3, this includes a flanged conduit 55*a* which extends into housing 3*a* adjacent seal leg 25. Conduit 55*a* is joined at its flanged end to a high voltage feed pipe 56 provided with a purge gas port 57*a* through which clean, dry, air or other purge gas from a pressurized source (not shown) is introduced. The end of the high voltage feed pipe 56 opposite conduit 55*a* terminates at high voltage power supply 39. The conduit 55*a* and high voltage feed pipe 56 assembly is referred to as the high voltage bus duct 58. The high voltage lead from power supply 39 is fed into high voltage bus duct 58 and connected to a rod 59. Rod 59 is fixed within high voltage bus duct 58 by threadedly engaging and passing through a feed through ceramic insulator 61 having a mounting flange 63 joined at its periphery to the interior of high voltage feed pipe 56. Mounting flange 63 is provided with holes to allow purge gas introduced through purge gas port 57*a* to flow through high voltage bus duct 58 and into housing 3*a*. Rod 59 extends along the centerline of high voltage bus duct 58 into housing 3*a*. A seal leg connector pipe 65 extends from the bottom side of seal leg cup 29 and is joined to rod 59 by T-connector 67. Rod 59, seal leg connector pipe 65, T-connector 67, seal leg 25 and lower support plate 19 are all made of electrically conductive material (e.g., stainless steel) such that one terminal of power supply 39 is electrically connected to filter element 13.

Figure 4:
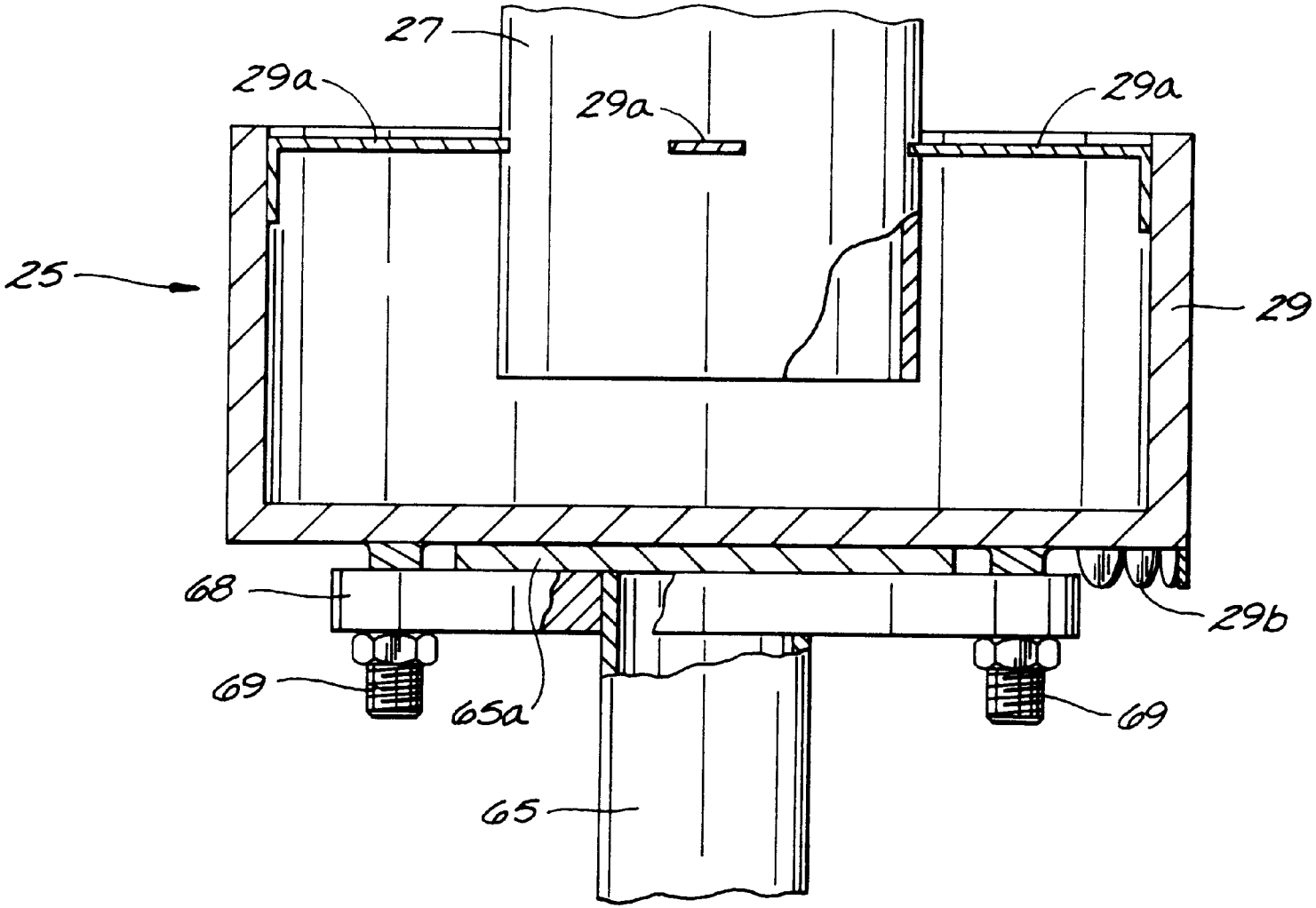
FIG. 4 is an enlarged section taken in the plane including line 4—4in FIG. 3.

The construction of seal leg 25 and the manner in which seal leg connector pipe 65 is joined to the bottom side of seal leg cup 29 is shown in greater detail in FIG. 4. FIG. 4 is an enlarged section taken in the plane including line 4—4 in FIG. 3. The seal leg comprises liquid drain conduit 27 extending into seal leg cup 29. The seal leg cup is of circular cross-section and is secured to the liquid drain conduit by several tabs 29*a* which extend from the sides of the seal leg cup. Tabs 29*a* are relatively small such that the seal leg cup is substantially open across the top. A scalloped edge 29*b* extends downwardly from the periphery of the bottom side of seal leg cup 29. only a portion of scalloped edge 29*b* is shown in FIG. 4, it being understood that the scalloped edge extends around the entire periphery of the bottom side of seal leg cup 29. Liquid waste draining from filter element 13 passes through liquid drain conduit 27 and into seal leg cup 29. Liquid waste overflows through the top of seal leg cup 29 and flows down the sides to a multiplicity of alternate drip points provided by scalloped edge 29*b*.

Seal leg connector pipe 65 has a flanged end 65*a* fixed to the end thereof opposite T-connector 67. Flanged end 65*a* abuts the bottom side of seal leg cup 29 and is held in place by retention plate 68 which in turn is fixed to the bottom side of the seal leg cup by threaded studs 69. The construction shown in FIG. 4 allows selective orientation of the seal leg connector pipe and T-connector combination 65 and 67 such that it can be readily aligned with rod 59 extending into housing 3*a* from high voltage bus duct 58.

Conduit 55*a* and high voltage feed pipe 56 shown in FIG. 3 may suitably be made from electrically insulative, corrosion-resistant material such as FRP. In addition, ground electrode 37*b* extends into and is made integral with high voltage bust duct 58 by lining the interior surface of conduit 55*a* and high voltage feed pipe 56 with a sufficiently electrically conductive and corrosion-resistant material as described above with respect to housing 3*a*. The grounded terminal of power supply 39 is electrically connected to ground electrode 37*b* integrated in housing 3*a* and high voltage bus duct 58 by one or more grounding lugs 40*c* extending into these components into contact with the ground electrode. Although only two are shown in FIG. 3, a multiplicity of grounding lugs 40*c* are preferably uniformly distributed over substantially the entire housing 3*a* and high voltage bus duct 58 with an areal density of at least about 10 lugs/$m^2$. Alternatively, housing 3*a*, conduit 55*a* and high voltage feed pipe 56 may be constructed from carbon steel and lined with a static dissipative plastic coating or other sufficiently electrically conductive, corrosion-resistant material to form an integral ground electrode 37*b*. This may provide cost advantages over FRP and other materials of construction and would allow the connection between the ground electrode and the grounded terminal of the power supply to be made from the external surfaces of the apparatus.

As shown in FIG. 3, housing 3*a* is further provided with purge gas nozzles 47*b* both above and below upper flange 9*c* through which heated, filtered air or other purge gas from a pressurized source (not shown) is introduced into gap 45*b*. Purge gas introduced into gap 45*b* inhibits electrically conductive material entrained in the untreated gas from depositing on the interior surface of housing 3*a* and the exterior surface of clean gas conduit 9*b* which might otherwise undermine the substantial electrical isolation of the filter element and seal leg combination 13 and 25 at the desired maximum design voltage.

Fogging nozzles 23 for irrigating the filter element 13 are threaded into the sides of housing 3*a* and terminate flush with the interior surface of the housing. The fogging nozzles may be made of metal or plastic and are in selective fluid communication with a source of liquid (not shown). The fogging nozzles in FIG. 3 are positioned at several elevations adjacent filter element 13. One or more sets of fogging nozzles 23, each set containing multiple nozzles positioned at the same elevation around housing 3*a* (e.g., sets of four fogging nozzles at 90° increments) may be employed. If sets of multiple fogging nozzles 23 positioned around the housing at various elevations are employed, it may be advantageous to increase the flow rate of liquid through each set of nozzles at different times. For example, once the pressure drop across the filter element has increased to a predetermined value during the gas cleaning process, the flow rate of liquid through the set of nozzles at the highest elevation may be increased first followed by each set at lower elevations in succession from top to bottom. Of course, operation of the fogging nozzles in any desired manner is readily adapted to automated control.

The apparatus 1*b* shown in FIG. 3 can be designed to handle a gas flow capacity of 60 $m^3$/min. or more. However, there are practical limitations to the size of gas cleaning apparatus in accordance with the present invention. For applications requiring even larger gas flow rates, multiple gas cleaning apparatus can be operated in parallel. The embodiment shown in FIG. 3 is readily adapted to a modular system configuration wherein varying numbers of gas cleaning apparatus (i.e., modules) may be operated in parallel to provide a gas cleaning system of any desired gas flow capacity. An example of a modular gas cleaning system 70 in accordance with the present invention is shown in FIG. 5.

Figure 5:
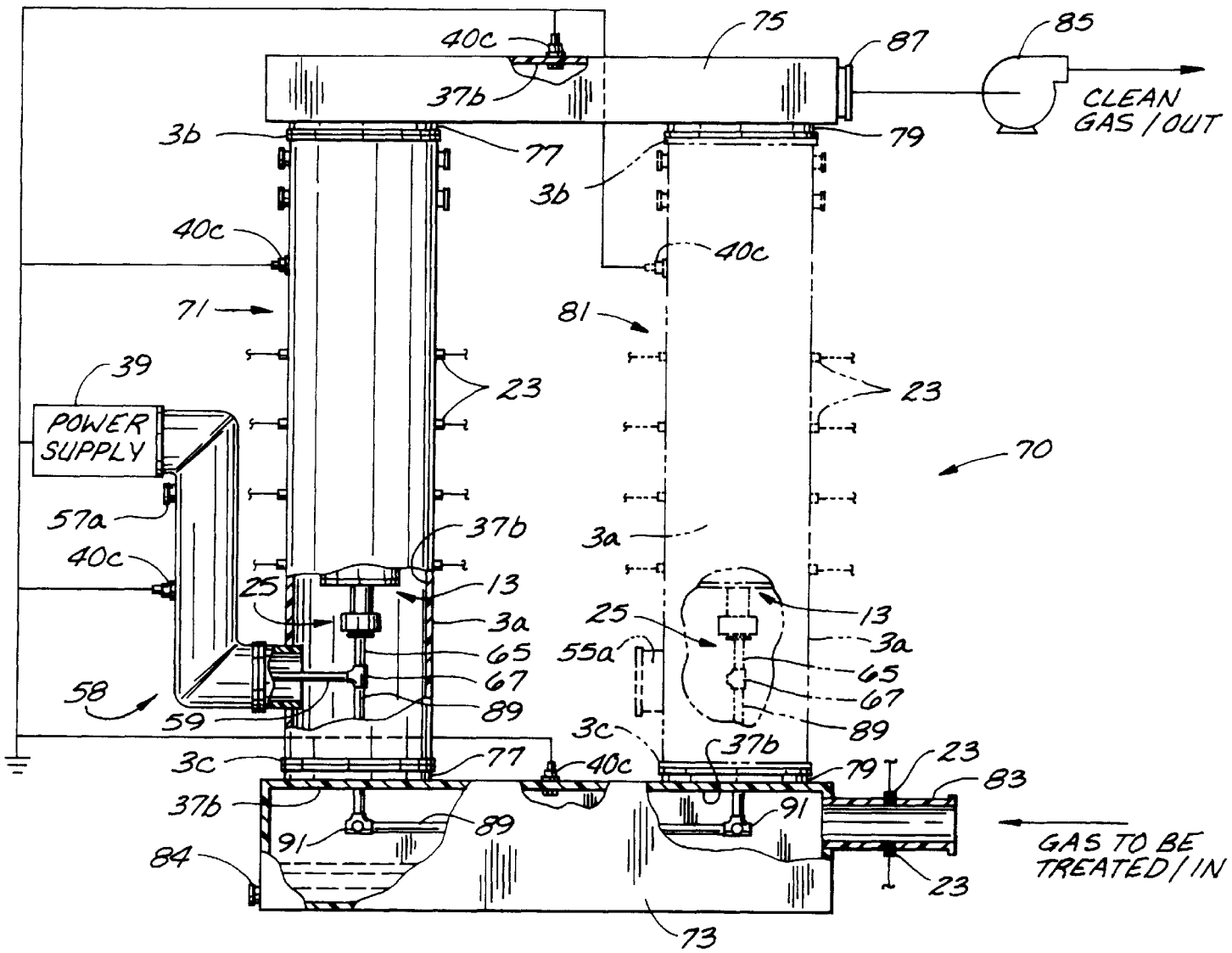
FIG. 5 is an elevation and partial schematic of a modular gas cleaning system in accordance with the present invention with portions broken away to show the internal construction thereof. The system shown in FIG. includes two gas cleaning apparatus of the type shown in FIG. 3, one of which is shown in phantom.

FIG. 5 is an elevation and partial schematic of a modular gas cleaning system in accordance with the present invention with portions broken away to show the internal construction thereof. The system shown in FIG. 5 includes a first gas cleaning apparatus or module 71 identical to the apparatus 1*b* shown in FIG. 3. The system further includes an intake manifold 73 and a clean gas manifold 75 provided with flanged ports 77 sized for connection to bottom flanged end 3*c* and top flanged end 3*b* of module 71. The intake and clean gas manifolds further include one or more pairs of additional flanged ports 79. Thus, the intake and clean gas manifolds are adapted for connection to a variable number of modules such that the system may accommodate variations in gas flow capacity demands as needed. A second such module 81 is shown in phantom in FIG. 5 having its bottom flanged end 3*c* and top flanged end 3*b* connected to flanged ports 79 of the intake and clean gas manifolds, respectively. The second module is also identical to the gas cleaning apparatus 1*b* shown in FIG. 3, except that it is not provided with a high voltage feed as previously described. Accordingly, conduit 55*a* of module 81 is closed at its flanged end. The electrical connection between modules 71 and 81 and power supply 39 is described in detail below. Once the system is assembled, the intake and clean gas manifolds are in fluid communication through the modules. If a second module is not required, flanged ports 79 are simply closed with a blind flange.

Intake and clean gas manifolds 73 and 75 may be suitably constructed of FRP or other electrically insulative, corrosion-resistant material. Furthermore, ground electrode 37*b* may extend into and be made integral with the interior surface of the intake and clean gas manifolds by lining these components with a static dissipative plastic coating or other sufficiently electrically conductive, corrosion-resistant material as described above with respect to housing 3*a* of modules 71 and 81. The grounded terminal of power supply 39 is electrically connected to ground electrode 37*b* integrated in intake and clean gas manifolds 73 and 75 by one or more grounding lugs 40*c* extending into these components into contact with the ground electrode.

Intake manifold 73 is provided with a gas inlet duct 83 through which gas to be treated is introduced into the system. One or more fogging nozzles 23 are directed into gas inlet duct 83 such that gas to be treated upon entering the system is contacted with a liquid spray and liquid droplets from the fogging nozzles are entrained in the gas to be treated. Preferably, the incoming gas is substantially saturated with liquid. The intake manifold distributes the flow of gas to be treated between modules 71 and 81. The intake manifold also serves as a universal sump for collecting liquid waste draining from modules 71 and 81 during the gas cleaning operation. Liquid waste is removed from the intake manifold through sump drain 84. The gas to be treated passes from intake manifold 73 upwardly through modules 71 and 81 and clean gas is collected in clean gas manifold 75. A fan or blower 85 connected to a clean gas exit port 87 on clean gas manifold 75 provides the motive force for moving gas through the system.

The filter media within element 13 of modules 71 and 81 may be electrostatically charged by a single high voltage direct current power supply 39. The electrical connection between module 71 and one terminal of the power supply is provided by the high voltage feed through connection shown in FIG. 3 and described above. The filter media within filter element 13 of module 81 is in turn connected to power supply 39 in parallel to the filter media within filter element 13 of module 71. As shown in FIG. 5, the electrical connection between the filter media in modules module 71 and 81 may pass through the intake manifold. This connection is readily provided by a module connector rod 89 extending from the T-connector 67 beneath seal leg 25 in module 71 through intake manifold 73 above the liquid level line and joining T-connector 67 beneath seal leg 25 in module 81. Conventional pipe connectors 91 may be used in routing module connector rod 89 from one module to another. Both the module connector rod and the associated pipe connectors are made of electrically conductive material (e.g., stainless steel).

A modular gas cleaning system in accordance with the present invention may employ multiple direct current power supplies to separately charge the filter element of each module. For example, each module could be provided with a separate high voltage feed through connection of the type shown in FIG. 3. Such an arrangement may improve the degree of control possible with respect to minimizing spark over within each individual module under design operating conditions. However, it is believed that the benefits of such an approach will be outweighed in most applications by the increased system complexity and higher capital and operating expenditures.

Although the system shown in FIG. 5 includes only two modules, the modular system in accordance with the present invention can be constructed so as to readily accommodate any number of modules to provide a system that can adapt to wide ranging gas flow capacity demands, for example, in the case of plant expansion. Other advantages of the modular gas cleaning system include flexible layout and space requirements, ease in delivering additional modules ready for installation at a plant site and improved safety.

Various modifications and adaptations of the process and apparatus disclosed above are possible. For example, the filter element containing the electrically conductive filter media need not be in the form of a substantially vertical cylinder but might instead be in the form of a bag, pleated element, flat or any other suitable shape. It may be desirable to operate two or more gas cleaning apparatus of the present invention in series such that treated gas exiting a first apparatus is fed to a second apparatus. Such an arrangement might be useful in applications requiring extremely high particle collection efficiencies. Furthermore, a gas cleaning system having high gas flow capacity may be provided by suspending multiple filter elements in accordance with the present invention from a flange within a single vessel provided with appropriate grounding elements, high voltage, purge air and liquid spray feeds. However, due to the increased complexity and higher capital costs, such an alternative gas cleaning system is believed to be less preferred than the modular system described above.

The present invention is illustrated by the following examples which are merely for the purpose of illustration and are not to be regarded as limiting the scope of the invention or manner in which it may be practiced.

EXAMPLE 1

In the following examples, gas cleaning apparatus in accordance with the present invention were operated to remove fine bentonite clay particles (Fisher Scientific, Fairlawn, N.J., U.S.A., Catalog No. B 235-500) entrained in air streams. Tap water was used to humidify the gas to be treated and irrigate the filter element.

The experimental system included a gas inlet conduit connected to the inlet port of the gas cleaning apparatus for introducing a gas stream to be treated into the housing of the apparatus and a gas outlet conduit connected to the outlet port of the apparatus through which clean gas was discharged from the housing of the apparatus. A gas blower (EG & G, Saugerties, N.Y., U.S.A., Model Rotron DR 505, 4.5 $Nm^3$/min. max., 20.7 kPa) connected to the gas outlet conduit was used to draw the gas to be treated through the gas cleaning apparatus. Gas sampling ports provided in the gas inlet and outlet conduits were used to direct samples of gas flowing through the conduits to conventional inertial impactors (Anderson, Smyrna, Ga., U.S.A., Model Mk3) to determine particle concentrations in the gas streams and fractional collection performance of the gas cleaning apparatus as described in greater detail below.

The gas inlet conduit further included a dust feed port upstream of the gas sampling port. A screw-type dust feeder was connected to the dust feed port for feeding bentonite clay particles into the inlet conduit. The gas to be treated was prepared by introducing bentonite clay particles fed by the dust feeder into a stream of ambient air drawn into the gas inlet conduit. The loading of bentonite clay particles in the gas to be treated was controlled by adjusting the speed of the motor used to drive the screw feeder. A high pressure air nozzle directed into the dust feed port was used to improve the dispersion of bentonite clay particles in the gas to be treated.

Pressure taps and pressure gages were provided at appropriate locations in the gas cleaning apparatus to determine pressure drop across the filter element. Also, an electronic pressure differential cell was used to continuously monitor the pressure drop across the filter element versus time. The gas flow rate through the gas cleaning apparatus was determined by the pressure drop across a calibrated orifice meter (North American, Cleveland, Ohio, U.S.A., orifice plate No. 2000) installed in the gas outlet conduit.

The experimental setup further included a liquid waste recirculation pump and level controlling circuits designed such that experiments could be run either in a mode in which humidification and irrigation water passes through the system a single time or in a mode in which liquid waste removed from the housing of the gas cleaning apparatus is recirculated through the fogging nozzles, with appropriate purge and make up water, to simulate field conditions. The recirculated liquid waste could be used for both inlet gas humidification and irrigation of the filter element.

This Example demonstrates, among other things, the use of stainless steel wool as the electrically conductive filter media in the wet electrostatic filtration system of the present invention. The filter element was constructed by winding approximately 2.2 kg of stainless steel wool comprised of fibers having a mean fiber diameter of about 82 $\mu$m onto a cylindrical, perforated support screen having an outside diameter of about 8.9 cm and a height of about 30.5 cm. The resulting layer of electrically conductive filter media was substantially uniform having a thickness of approximately 4.3 cm and a bulk density of about 415.2 kg/$m^3$. The void fraction calculated for the layer of stainless steel wool was 0.944. The pressure drop across the dry stainless steel wool filter element was very low (less than 0.01 kPa at a gas velocity of 15.2 cm/s). The filter element was installed in the housing of a gas cleaning apparatus substantially similar to the apparatus shown and described in FIG. 1 such that the distance separating the upstream surface of the layer of stainless steel wool and the ground screen was about 5.9 cm.

Suspensions of bentonite clay particles in tap water exhibit a negative zeta potential (i.e., have a negative surface charge). Thus, in accordance with the preferred embodiment of the present invention, the filter element was electrically connected to the negative terminal of the direct current power supply (SIMCO, Hatfield, Pa., U.S.A., Model No. CH25) such that a negative potential could be applied to the stainless steel wool filter media.

In all the tests conducted in this Example, the system was operated such that the gas velocity through the stainless steel wool filter media was about 18.8 cm/s and the loading of bentonite clay particles and water droplets in the gas introduced into the filter element was about 110 mg/$m^3$ and about 53 g/$m^3$, respectively. The fogging nozzles were operated continuously to obtain a filter element irrigation rate of about 0.61 l/min./$m^2$. The filter element irrigation rate was determined by measuring the rate at which liquid waste drained directly from the filter element. Furthermore, in this Example, the experimental system was run in the once through water mode. That is, fresh tap water was introduced through the fogging nozzles for gas humidification and fiber bed irrigation rather than supplying the fogging nozzles with liquid waste recirculated from the housing of the gas cleaning apparatus.

The only process variable which was changed in the tests conducted in this Example was the magnitude of the negative direct current voltage applied to the stainless steel wool filter media. In three separate tests, the voltage applied to the stainless steel wool filter media was −20 kv (Test 1), −10 kv (Test 2) and 0 kv (Test 3). During Tests 1 and 2 the current drawn by the direct current power supply was about 0.8 mA and about 0.4 mA, respectively.

During each of the three tests, samples of the gas to be treated and of the clean gas were drawn from the appropriate gas sampling port and directed to the associated inertial impactor. Conventional isokinetic sampling procedures were followed to eliminate sampling errors. The solid and liquid material collected on the several stage plates in the inertial impactors was dried in a desiccator to remove moisture and then weighed. A five place analytical balance (Mettler, Hightstown, N.J., U.S.A., Model AT 261) was used for gravimetric analysis. The concentration of bentonite clay particles of various diameters in the gas to be treated and the clean gas was then determined by dividing the dried weight of material collected on an individual stage plate by the gas sample volume. The results are summarized below in Table 1.

TABLE 1

| | | Test 1 −20 kv | | Test 2 −10 kv | | Test 3 0 kv | |
|---|---|---|---|---|---|---|---|
| Particle Diameter (μm) | Inlet Conc. (mg/m$^3$) | Exit Conc. (mg/m$^3$) | Collection Efficiency (%) | Exit Conc. (mg/m$^3$) | Collection Efficiency (%) | Exit Conc. (mg/m$^3$) | Collection Efficiency (%) |
| ≧7.22 | 98.746 | 0.004 | 100.00 | 0.509 | 99.46 | 0.219 | 99.78 |
| <7.22 ≧4.57 | 1.437 | 0.000 | 100.00 | 0.000 | 100.00 | 0.000 | 100.00 |
| <4.57 ≧3.03 | 0.656 | 0.009 | 98.70 | 0.006 | 99.09 | 0.000 | 100.00 |
| <3.03 ≧2.13 | 0.897 | 0.000 | 100.00 | 0.000 | 100.00 | 0.000 | 100.00 |
| <2.13 ≧1.35 | 2.815 | 0.000 | 100.00 | 0.005 | 99.82 | 0.002 | 99.94 |
| <1.35 ≧0.69 | 3.270 | 0.000 | 100.00 | 0.013 | 99.57 | 0.074 | 97.75 |
| <0.69 ≧0.40 | 1.611 | 0.002 | 99.88 | 0.053 | 96.60 | 0.023 | 98.55 |
| <0.40 ≧0.26 | 0.232 | 0.004 | 98.36 | 0.000 | 100.00 | 0.010 | 95.67 |
| <0.26 | 0.134 | 0.000 | 100.00 | 0.022 | 82.90 | 0.052 | 61.25 |
| Total | 109.797 | 0.018 | 99.98 | 0.607 | 99.42 | 0.380 | 99.65 |

With the application of high direct current voltage to the stainless steel wool filter media in Tests 1 and 2, a very high collection efficiency was maintained, even for submicron solid particles. Furthermore, in Tests 1 and 2, the pressure drop across the wetted stainless steel wool filter element remained essentially constant at about 0.07 kPa, indicating that collected bentonite clay particles were being efficiently removed from the stainless steel wool fibers by the draining liquid without a net decrease in the operating void fraction of the filter media. However, during the power off experiment in Test 3, the collection efficiency of submicron solid particles decreased, especially as compared to the results obtained in Test 1. Furthermore, in Test 3, after operation for about 24 hours, the pressure drop across the wetted stainless steel wool filter element was about 10 percent higher than that measured in Tests 1 and 2. The increased pressure drop indicates that collected bentonite clay particles were not being removed from the wetted filter media by the draining liquid as efficiently as compared to when a negative voltage was applied to the filter element in Tests 1 and 2.

EXAMPLE 2

This Example demonstrates, among other things, the contribution that an electrostatic charge on the filter media makes to the removal of collected solid particles from the filter media, regardless of the polarity of the electric potential applied to the filter media. The benefits of selecting the polarity of the electric potential applied to the filter media so as to enhance removal of collected solid particles from the filter media are also demonstrated.

The gas cleaning apparatus employed in this Example was substantially the same as that described in Example 1 except for the following differences. The layer of stainless steel wool filter media comprised approximately 1.42 kg of fibers having a diameter ranging from about 50 μm to about 150 μm and had a bulk density of about 560.6 kg/m$^3$. The void fraction calculated for the layer of stainless steel wool was about 0.931. The pressure drop across the dry stainless steel wool filter element was about 0.1 kPa at a gas velocity of 14.2 cm/s.

In all the tests conducted in this Example, the system was operated such that the gas velocity through the stainless steel wool filter media was about 14.2 cm/s and the loading of bentonite clay particles in the gas to be treated was about 353 mg/m$^3$. The fogging nozzles were operated continuously to obtain a filter element irrigation rate of about 4.1 l/min./m$^2$. In this Example, liquid waste drained from the housing of the gas cleaning apparatus (0.007 percent solids content) was recirculated to the fogging nozzles for gas humidification and fiber bed irrigation.

The only process variable which was changed in the tests conducted in this Example was the polarity of the direct current voltage applied to the stainless steel wool filter media. In Test 1, a voltage of −20 kv was applied to the stainless steel wool filter media, while in Test 2 the voltage applied to the stainless steel filter media was +20 kv. During Tests 1 and 2, the current drawn by the direct current power supply was about 0.2 mA.

In each test, the system was operated for a period of time long enough to establish a steady state pressure drop across the wetted stainless steel wool filter element. In addition, the turbidity of liquid waste draining directly from the filter element was periodically determined using a calibrated turbidity meter (H.F. Scientific, Fort Myers, Fla., U.S.A., Model DRT 15CE). The turbidity of the liquid drained from the housing of the gas cleaning apparatus was also measured. The results for Tests 1 and 2 are summarized in Tables 2 and 3, respectively, below. In the following Tables, the measured turbidity is given in nephelometric turbidity units (NTU) and is linearly related to the concentration of insoluble solid particles in the liquid waste.

TABLE 2

| Test 1 −20 kv | |
|---|---|
| Steady State Pressure Drop Across Wetted Filter Element | 1.38 kPa |
| System Pressure Drop | 7.16 kPa |
| Filter Element Drain Rate | 150 $cm^3$/min. |
| Housing Drain Turbidity | 98.8 NTU |
| Liquid Waste Sample | NTU |
| A | 14.70 |
| B | 11.80 |
| C | 10.40 |
| D | 11.40 |
| E | 11.20 |
| F | 10.70 |
| G | 10.10 |
| H | 8.89 |
| I | 9.92 |
| J | 9.21 |
| K | 9.34 |
| L | 10.27 |
| Average Liquid Waste Turbidity | 10.7 |

TABLE 3

| Test 2 +20 kv | |
|---|---|
| Steady State Pressure Drop Across Wetted Filter Element | 1.59 kPa |
| System Pressure Drop | 7.95 kPa |
| Filter Element Drain Rate | 187 $cm^3$/min. |
| Housing Drain Turbidity | 97.8 NTU |
| Liquid Waste Sample | NTU |
| A | 19.60 |
| B | 11.30 |
| C | 9.62 |
| D | 9.05 |
| E | 9.10 |
| F | 8.20 |
| G | 7.51 |
| H | 7.10 |
| I | 7.55 |
| J | 7.85 |
| K | 7.41 |
| L | 7.95 |
| Average Liquid Waste Turbidity | 9.4 |

The steady state pressure drop across the wetted filter element increased about 15 percent when the polarity of the potential applied to the stainless steel filter media was switched from negative (Test 1) to positive (Test 2). Also, the turbidity of the liquid waste drained from the filter element decreased from Test 1 to Test 2. These results suggest that collected bentonite clay particles accumulated in the stainless steel filter media to a greater extent when the electric potential applied to the filter media was positive. It is believed that bentonite clay particles collected in the negatively charged filter media were more easily removed from the filter media by the draining liquid due to the effects of electrophoresis. Nevertheless, these results demonstrate, that it is possible to practice the process of the present invention without exercising the preferred mode of operation, although with an increase in operating cost due to the higher pressure drop across the filter element.

EXAMPLE 3

This Example demonstrates, among other things, the use of a woven carbon fiber fabric as the electrically conductive filter media in the wet electrostatic filtration system of the present invention.

In this and the following Examples, a gas cleaning apparatus similar to that shown in FIG. 2 was employed.

A woven carbon fiber fabric comprised of fibers having a diameter of about 8 $\mu$m (Taconic, Fort Fairfield, Me., U.S.A., style TCWG-136, 8.2 oz/$yd^2$, 3K carbon filament, weave 2×2 twill) was used as the electrically conductive filter media. The filter element was constructed by first wrapping a conventional wire mesh pad as a reentrainment control layer onto a cylindrical, perforated support screen having an outside diameter of about 8.9 cm and a height of about 30.5 cm. The mesh pad comprised stainless steel fibers having a fiber diameter of about 280 $\mu$m. The woven carbon fiber fabric was then wound around the support screen in contact with the exterior surface of the mesh pad to obtain an overall thickness (woven carbon fabric+mesh pad) of approximately 2.5 cm. The woven carbon fabric/mesh pad composite had a bulk density of about 240.3 kg/$m^3$. The pressure drop across the dry woven carbon fabric/mesh pad composite was about 0.15 kPa at a gas velocity of 20.8 cm/s. The filter element was installed in the housing of the gas filtration apparatus shown in FIG. 2 such that the distance separating the upstream surface of the carbon fiber fabric and the ground screen was about 7.6 cm. In accordance with the preferred embodiment of the present invention, the filter element was connected to the negative terminal of the direct current power supply such that a negative potential could be applied to the carbon fiber filter media.

In all the tests conducted in this Example, the system was operated such that the gas velocity through the woven carbon fabric/mesh pad composite was about 20.8 cm/s and the loading of bentonite clay particles in the gas to be treated was about 110 mg/$m^3$. The fogging nozzles were operated continuously to obtain a filter element irrigation rate of about 6.1 l/min./$m^2$. Liquid waste drained from the housing of the gas cleaning apparatus (0.04 percent solids content) was recirculated to the fogging nozzles for gas humidification and fiber bed irrigation.

The only process variable which was changed in the tests conducted in this Example was the direct current voltage applied to the woven carbon fabric/mesh pad composite. In Test 1, a voltage of −20 kv was applied to the filter media, while in Test 2 the power supply was turned off.

In each test, the system was operated for a period of time long enough to establish a steady state pressure drop of about 2.1 kPa across the wetted woven carbon fabric/mesh pad composite. In addition, samples of the gas to be treated and of the clean gas were drawn from the gas sampling ports and directed to the associated inertial impactor to determine particle concentrations in the gas streams and fractional collection performance of the gas cleaning apparatus. The conventional gravimetric analysis technique has limitations because bentonite clay is hygroscopic and achieving a controlled dryness to determine the weight change in a conventional inertial impactor stage plate is difficult. Therefore, a wet insoluble sampling method was developed to better quantify fractional collection efficiency. This method included washing each stage plate of the inertial impactor with a known volume of deionized water and then measuring the turbidity of the resulting wash using the calibrated turbidity meter used in Example 2. This data was then used to calculate the mass of insoluble particles collected in that stage. The results of this analysis are summarized below in Table 4.

TABLE 4

| | | Test 1 −20 kv | | Test 2 0 kv | |
|---|---|---|---|---|---|
| Particle Diameter (μm) | Inlet Conc. (mg/m³) | Exit Conc. (mg/m³) | Collection Efficiency (%) | Exit Conc. (mg/m³) | Collection Efficiency (%) |
| ≧7.61 | 50.320 | 0.061 | 99.88 | 0.071 | 99.86 |
| <7.61 ≧4.82 | 5.541 | 0.002 | 99.98 | 0.002 | 99.96 |
| <4.82 ≧3.20 | 5.651 | 0.002 | 99.98 | 0.002 | 99.96 |
| <3.20 ≧2.25 | 3.674 | 0.001 | 99.98 | 0.002 | 99.94 |
| <2.25 ≧1.43 | 4.760 | 0.003 | 99.94 | 0.006 | 99.87 |
| <1.43 ≧0.73 | 5.295 | 0.015 | 99.71 | 0.020 | 99.62 |
| <0.73 ≧0.43 | 2.711 | 0.029 | 99.06 | 0.044 | 98.39 |
| <0.43 ≧0.27 | 0.558 | 0.022 | 96.71 | 0.034 | 93.89 |
| <0.27 | 0.357 | 0.126 | 67.89 | 0.315 | 11.65 |
| Total | 78.865 | 0.259 | 99.70 | 0.496 | 99.37 |

It is noted that the performance of the woven carbon fabric/mesh pad composite is somewhat inferior to that of a stainless steel wool filter element due to the much higher pressure drop required to attain comparable collection efficiency of submicron size particles. Nevertheless, this material of construction is feasible and may have application in corrosive environments where special metal alloy fibers may be marginal.

EXAMPLE 4

This Example demonstrates, among other things, the benefits of the preferred embodiment of the process of the present invention in which the polarity of the electric potential applied to the filter media is selected so as to enhance removal of collected solid particles from the filter media by electrophoresis. More particularly, with respect to bentonite clay particles which exhibit a negative zeta potential when contacted with tap water, the present Example demonstrates the lower pressure drop across the wetted filter element and other beneficial effects obtained when a negative direct current voltage is applied to the filter media.

The same gas cleaning apparatus employed in Example 3, including the woven carbon fabric/mesh pad composite filter element, was used in this Example. The system was operated such that the gas velocity through the woven carbon fabric/mesh pad composite was about 20.8 cm/s and the loading of bentonite clay particles in the gas to be treated was about 110 mg/m³. The fogging nozzles were operated continuously to obtain a filter element irrigation rate of about 6.1 l/min./m². Liquid waste drained from the housing of the gas cleaning apparatus (0.04 percent solids content) was recirculated to the fogging nozzles for gas humidification and fiber bed irrigation.

Figure 6:
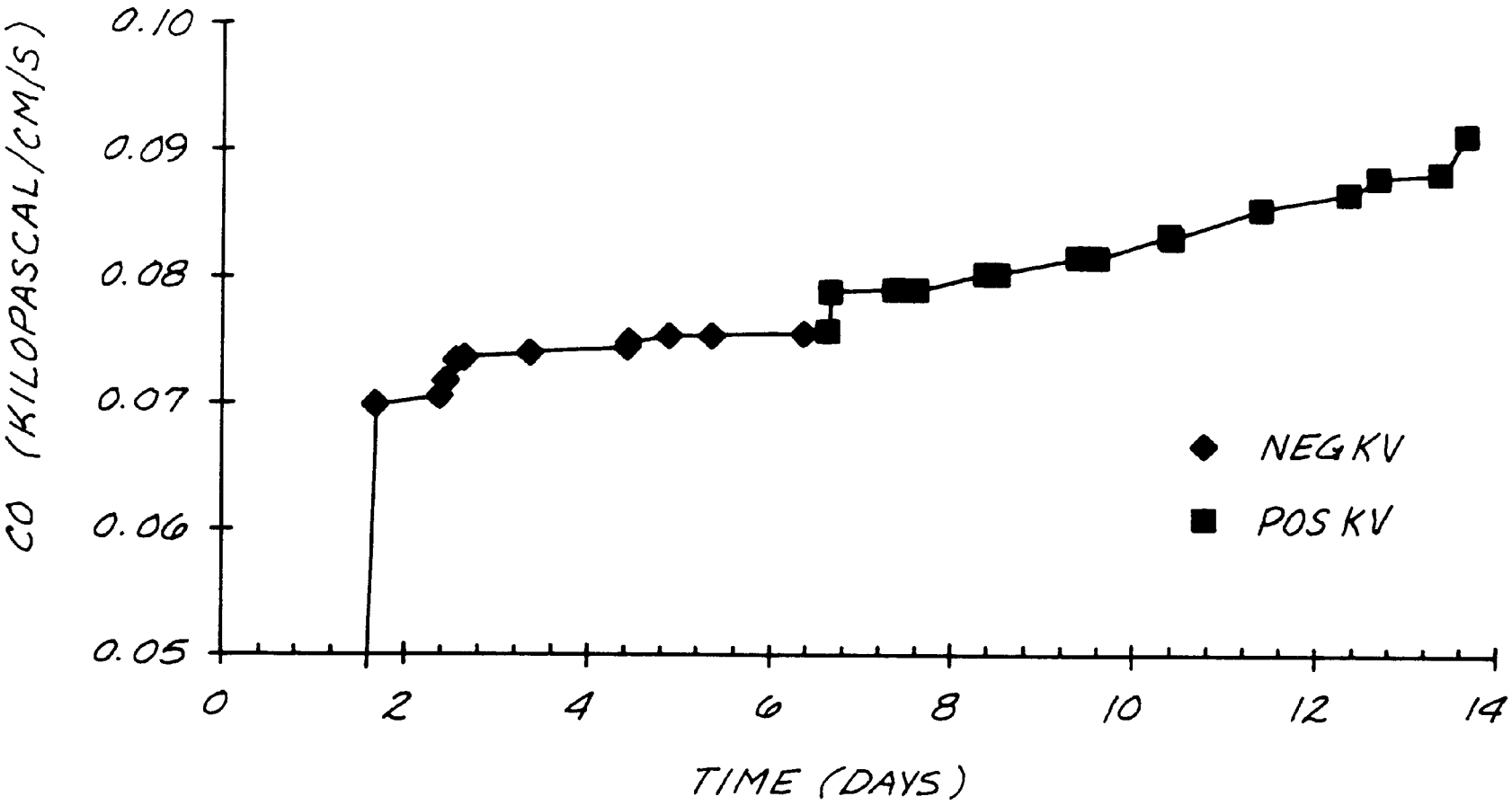
FIG. 6 shows the normalized pressure drop (Co) plotted as a function of time for the tests conducted in Example 4.

The system was first operated with a direct current voltage of −20 kv applied to the filter media for a period of time long enough to establish a steady state pressure drop of about 1.5 kPa across the wetted woven carbon fabric/mesh pad composite. These results are shown in FIG. 6. In FIG. 6, the normalized pressure drop (Co), defined as the ratio of the pressure drop across the wetted filter element in kPa to the gas velocity in cm/s, is plotted as a function of time. After about 3 days of continuous steady state operation, the direct current voltage applied to the woven carbon fabric/mesh pad composite was switched from −20 kv to about +16.5 kv. Thereafter, operation of the system was continued with a positive electric potential applied to the filter media for about 7 days. As shown in FIG. 6, the switch in the polarity of the voltage applied to the filter media was accompanied by a step increase in the normalized pressure drop. Furthermore, after the polarity of the electric potential applied to the filter media was switched, the normalized pressure drop across the wetted filter element steadily increased and never reached a steady state value. These results demonstrate the benefits of the preferred embodiment of the process of the present invention in which the polarity of the electric potential applied to the filter media is selected such that the charge on the filter media is the same as the surface charge on the insoluble solid particles collected in the wetted filter media. It is believed that by practicing the preferred embodiment of the process of the present invention, insoluble particles of bentonite clay collected in the wetted woven carbon fabric/mesh pad filter media were repulsed from the surfaces of the filter media and thereby more easily removed by the draining liquid such that a stable pressure drop across the filter element could be maintained.

EXAMPLE 5

This Example demonstrates, among other things, the effect of the diameter of stainless steel fibers used as the electrically conductive filter media has on the collection efficiency and pressure drop of the wet electrostatic filtration system of the present invention.

In Test 1, the filter element was constructed by first wrapping a conventional wire mesh pad as a reentrainment control layer onto a cylindrical, perforated support screen having an outside diameter of about 8.9 cm and a height of about 30.5 cm. The mesh pad comprised stainless steel fibers having a fiber diameter of about 280 μm and the reentrainment control layer was about 1.3 cm thick. Stainless steel wool comprised of fibers having a fiber diameter from about 50 μm to about 150 μm was then wound around the support screen in contact with the exterior surface of the mesh pad to obtain an overall thickness (stainless steel wool+mesh pad) of approximately 4.0 cm. The stainless steel wool/mesh pad composite had a bulk density of about 352.4 kg/m³. The pressure drop across the dry stainless steel wool/mesh pad composite was about 0.05 kPa at a gas velocity of 20.3 cm/s. The filter element was installed in the housing of the gas filtration apparatus such that the distance separating the upstream surface of the layer of stainless steel wool and the ground screen was about 6.4 cm.

In the filter element used in Test 2, a courser stainless steel wool comprised of fibers having a fiber diameter from about 90 μm to about 300 μm was substituted for the stainless steel wool used in the filter element of Test 1. The thickness of the stainless steel wool/mesh pad composite in the filter element used in Test 2 was about 3.4 cm and had a bulk density of about 320.4 kg/m³. The pressure drop across the dry stainless steel wool/mesh pad composite used in Test 2 was about 0.02 kPa at a gas velocity of 20.3 cm/s. The filter element was installed in the housing of the gas filtration apparatus such that the distance separating the upstream surface of the layer of stainless steel wool and the ground screen was about 6.7 cm.

In both Tests 1 and 2, the filter element was connected to the negative terminal of the direct current power supply and a negative direct current voltage of about −20 kv was applied to the stainless steel wool filter media. The system was operated such that the gas velocity through the stainless steel wool/mesh pad composite was about 20.3 cm/s. The fogging nozzles were operated continuously to obtain a filter element irrigation rate of about 0.41 l/min./$m^2$. Liquid waste drained from the housing of the gas cleaning apparatus (0.04 percent solids content) was recirculated to the fogging nozzles for gas humidification and fiber bed irrigation. In addition, the filter element irrigation rate was increased to about 4.1 l/min./$m^2$ once every 24 hours for a period of about 30 minutes. In Test 1, the loading of bentonite clay particles in the gas to be treated was about 110 mg/$m^3$, while in Test 2 the loading of bentonite clay particles in the gas to be treated was about 73 mg/$m^3$.

In Tests 1 and 2, the system was first operated for a period of time long enough to establish a steady state pressure drop across the wetted stainless steel wool/mesh pad composite of about 0.09 kPa and about 0.07 kPa, respectively. Samples of the gas to be treated and of the clean gas were drawn from the gas sampling ports and directed to the associated inertial impactor while the system was operated at the low filter element irrigation rate. The particle concentrations in the gas streams and fractional collection performance of the gas cleaning apparatus was determined using the wet insoluble sampling method described in Example 3. The results for Tests 1 and 2 are summarized below in Tables 5 and 6, respectively.

TABLE 5

Test 1 - Fine Stainless Steel Wool

| Particle Diameter (μm) | Inlet Conc. (mg/$m^3$) | Exit Conc. (mg/$m^3$) | Collection Efficiency (%) |
|---|---|---|---|
| ≧7.61 | 60.361 | 0.036 | 99.94 |
| <7.61 ≧4.82 | 5.576 | 0.003 | 99.95 |
| <4.82 ≧3.20 | 6.420 | 0.003 | 99.95 |
| <3.30 ≧2.25 | 4.068 | 0.004 | 99.91 |
| <2.25 ≧1.43 | 4.703 | 0.014 | 99.71 |
| <1.43 ≧0.73 | 5.493 | 0.069 | 98.75 |
| <0.73 ≧0.43 | 2.514 | 0.061 | 97.57 |
| <0.43 ≧0.27 | 0.535 | 0.023 | 95.78 |
| <0.27 | 0.359 | 0.034 | 90.50 |
| Total | 90.030 | 0.246 | 99.73 |

TABLE 6

Test 2 - Course Stainless Steel Wool

| Particle Diameter (μm) | Inlet Conc. (mg/$m^3$) | Exit Conc. (mg/$m^3$) | Collection Efficiency (%) |
|---|---|---|---|
| ≧7.61 | 46.413 | 0.028 | 99.87 |
| <7.61 ≧4.82 | 5.110 | 0.001 | 99.83 |
| <4.82 ≧3.20 | 5.212 | 0.001 | 99.88 |
| <3.30 ≧2.25 | 3.389 | 0.002 | 99.83 |
| <2.25 ≧1.43 | 4.390 | 0.010 | 99.61 |
| <1.43 ≧0.73 | 4.884 | 0.045 | 98.57 |
| <0.73 ≧0.43 | 2.500 | 0.053 | 97.34 |
| <0.43 ≧0.27 | 0.515 | 0.025 | 94.22 |
| <0.27 | 0.329 | 0.112 | 58.18 |
| Total | 72.743 | 0.277 | 99.44 |

The increase in the diameter of the stainless steel wool filter media from Test 1 to Test 2 was accompanied by a decrease in the submicron particle collection efficiency. This is as expected and is in agreement with the known theories of gas particle separation. In the practice of the present invention, the benefits of using finer diameter fibers in the filter media must be balanced against increased sensitivity to particle loading which may necessitate more frequent intermittent washing at a higher irrigation rate and potentially shorter life span in corrosive environments. The selection of fiber diameter in view of these various considerations will vary from application to application and is well understood by those skilled in the art.

EXAMPLE 6

This Example demonstrates, among other things, the effect of the gas velocity has on the collection efficiency of the wet electrostatic filtration system of the present invention.

The same gas cleaning apparatus employed in Test 1 of Example 5, including the fine stainless steel wool/mesh pad composite filter element, was used in this Example.

In both Tests 1 and 2, the filter element was connected to the negative terminal of the direct current power supply and a negative direct current voltage of about −24 kv was applied to the stainless steel wool filter media. The filter element was irrigated as described above in Example 5. In Test 1, the loading of bentonite clay particles in the gas to be treated was about 90 mg/$m^3$ and the system was operated such that the gas velocity through the stainless steel wool/mesh pad composite was about 20.3 cm/s. In Test 2, the loading of bentonite clay particles in the gas to be treated was about 75 mg/$m^3$ and the gas velocity through the stainless steel wool/mesh pad composite was increased to about 25.4 cm/s. In Tests 1 and 2, the system was first operated for a period of time long enough to establish a steady state pressure drop across the wetted stainless steel wool/mesh pad composite of about 0.09 kPa and about 0.1 kPa, respectively. Samples of the gas to be treated and of the clean gas were drawn from the gas sampling ports and directed to the associated inertial impactor while the system was operated at the low filter element irrigation rate. The particle concentrations in the gas streams and fractional collection performance of the gas cleaning apparatus was determined using the wet insoluble sampling method described in Example 3. The results for Tests 1 and 2 are summarized below in Tables 7 and 8, respectively.

TABLE 7

Test 1 - 20.3 cm/s Gas Velocity

| Particle Diameter (μm) | Inlet Conc. (mg/m³) | Exit Conc. (mg/m³) | Collection Efficiency (%) |
|---|---|---|---|
| ≧7.61 | 60.361 | 0.008 | 99.99 |
| <7.61 ≧4.82 | 5.576 | 0.002 | 99.97 |
| <4.82 ≧3.20 | 6.420 | 0.001 | 99.98 |
| <3.30 ≧2.25 | 4.068 | 0.001 | 99.98 |
| <2.25 ≧1.43 | 4.703 | 0.001 | 99.97 |
| <1.43 ≧0.73 | 5.493 | 0.001 | 99.98 |
| <0.73 ≧0.43 | 2.514 | 0.003 | 99.88 |
| <0.43 ≧0.27 | 0.535 | 0.003 | 99.51 |
| <0.27 | 0.359 | 0.031 | 91.43 |
| Total | 90.030 | 0.051 | 99.94 |

TABLE 8

Test 2 - 25.4 cm/s Gas Velocity

| Particle Diameter (μm) | Inlet Conc. (mg/m³) | Exit Conc. (mg/m³) | Collection Efficiency (%) |
|---|---|---|---|
| ≧7.61 | 50.012 | 0.017 | 99.97 |
| <7.61 ≧4.82 | 4.620 | 0.004 | 99.91 |
| <4.82 ≧3.20 | 5.319 | 0.005 | 99.91 |
| <3.30 ≧2.25 | 3.371 | 0.004 | 99.88 |
| <2.25 ≧1.43 | 3.897 | 0.008 | 99.80 |
| <1.43 ≧0.73 | 4.551 | 0.044 | 99.04 |
| <0.73 ≧0.43 | 2.083 | 0.052 | 97.50 |
| <0.43 ≧0.27 | 0.443 | 0.020 | 95.43 |
| <0.27 | 0.298 | 0.034 | 88.43 |
| Total | 74.594 | 0.189 | 99.75 |

The increase in the gas velocity through the stainless steel wool/mesh pad composite from Test 1 to Test 2 was accompanied by a decrease in the submicron particle collection efficiency. This is also expected and is in agreement with the known theories of gas particle separation.

EXAMPLE 7

This Example demonstrates, among other things, the use of a metal and polymeric fiber co-knit material as the electrically conductive filter media in the wet electrostatic filtration system of the present invention.

A co-knit material (ACS Industries, Houston, Tex., U.S.A., Catalog No. 8TMW11) was employed as the electrically conductive filter media. The co-knit material was made from a continuous, Alloy 20 stainless steel wire (wire diameter of about 280 μm) and a woven TEFLON filament (fiber diameter of about 15 μm to about 30 μm). The filter element was constructed by winding the co-knit material onto a cylindrical, perforated support screen having an outside diameter of about 8.9 cm and a height of about 30.5 cm. The resulting layer of electrically conductive filter media was substantially uniform having a thickness of approximately 3.4 cm and a bulk density of about 224.3 kg/m³. The void fraction calculated for the layer of co-knit material was 0.968. The filter element was installed in the housing of the gas filtration apparatus such that the distance separating the upstream surface of the layer of co-knit material and the ground screen was about 6.7 cm. The pressure drop across the dry co-knit material was about 0.025 kPa at a gas velocity of 25.4 cm/s.

The filter element was connected to the negative terminal of the direct current power supply and a negative direct current voltage of about −20 kv was applied to the co-knit material filter media. The system was operated such that the gas velocity through the co-knit material filter media was about 25.4 cm/s. The fogging nozzles were operated continuously to obtain a filter element irrigation rate of about 0.41 l/min./m². Liquid waste drained from the housing of the gas cleaning apparatus (0.04 percent solids content) was recirculated to the fogging nozzles for gas humidification and filter element irrigation. In addition, the filter element irrigation rate was increased to about 4.1 l/min./m² once every 24 hours for a period of about 30 minutes. The loading of bentonite clay particles in the gas to be treated was maintained constant at about 42 mg/M³.

The system was first operated for a period of time long enough to establish a steady state pressure drop across the wetted layer of co-knit material of about 0.07 kPa. Samples of the gas to be treated and of the clean gas were drawn from the gas sampling ports and directed to the associated inertial impactor while the system was operated at the low filter element irrigation rate. The particle concentrations in the gas streams and fractional collection performance of the gas cleaning apparatus was determined using the wet insoluble sampling method described in Example 3. The results are summarized below in Table 9.

TABLE 9

Co-Knit Material, −20 kv

| Particle Diameter (μm) | Inlet Conc. (mg/m³) | Exit Conc. (mg/m³) | Collection Efficiency (%) |
|---|---|---|---|
| ≧6.27 | 18.23 | 0.0283 | 99.85 |
| <6.27 ≧3.97 | 1.985 | 0.0035 | 99.90 |
| <3.97 ≧2.63 | 1.667 | 0.0035 | 99.81 |
| <2.63 ≧1.85 | 1.017 | 0.0016 | 99.84 |
| <1.85 ≧1.17 | 1.275 | 0.0035 | 99.82 |
| <1.17 ≧0.59 | 1.335 | 0.0141 | 98.98 |
| <0.59 ≧0.34 | 0.6180 | 0.0177 | 97.10 |
| <0.34 ≧0.21 | 0.1554 | 0.0106 | 93.19 |
| <0.21 | 0.1624 | 0.0283 | 82.51 |
| Total | 26.44 | 0.1095 | 99.59 |

These results clearly demonstrate the technical feasibility of using a metal and polymeric fiber co-knit material as electrically conductive filter media in the practice of the present invention. The co-knit material combines a low dry pressure drop with a collection efficiency comparable to that achieved in the preceding examples using other materials as the filter media. The use of a metal and polymeric fiber co-knit material as the electrically conductive filter media is preferred in corrosive environments (e.g., treatment of acid mist-containing effluents) where a material cost advantage may be realized as compared to a filter media comprised solely of corrosion-resistant, high alloy metal fibers. It should be further noted that in the construction of this co-knit material, a continuous metal wire is employed. Therefore, in spite of the presence of the woven TEFLON filament, the voltage applied to the co-knit material is distributed uniformly over the filter media.

In view of the above, it will be seen that the several objects of the invention are achieved. As various changes could be made in the above-described processes and apparatus without departing from the scope of the invention, it is intended that all matter contained in the above description be interpreted as illustrative and not in a limiting sense.

What is claimed is:

1. A process for treating a gas stream to remove solid or liquid particles entrained in the gas stream, the process comprising:

providing a substantially electrically isolated, gas-permeable filter element comprising electrically conductive filter media wetted with a liquid;

electrostatically charging the wetted filter media by applying an electric potential to the filter media with respect to ground;

passing the gas stream to be treated through an electric field imposed by a limited current discharge between the electrostatically charged filter media and a ground electrode to induce a charge on particles entrained in the gas having a polarity opposite of the charge on the filter media;

passing the gas stream containing charged particles through the filter element with a horizontal component of movement, the entrained particles thereby being captured in the wetted filter media to produce a clean gas stream from which entrained particles have been removed; and continuously draining the liquid from the wetted filter media under the force of gravity to remove captured particles and produce a liquid waste containing the removed particles exiting the filter element, the draining liquid having a horizontal component of movement through the filter media toward the downstream surface of the filter element relative to the direction of gas flow through the filter element imparted by the gas drag force.

2. A process as set forth in claim 1 wherein the liquid wetting the filter media is aqueous.

3. A process as set forth in claim 2 further comprising contacting the gas stream to be treated with a spray of aqueous liquid droplets upstream of the filter element relative to the direction of gas flow, aqueous liquid droplets thereby being entrained in the gas to be treated, the entrained liquid droplets being captured in and wetting the filter media with aqueous liquid as the gas passes through the filter element.

4. A process as set forth in claim 3 wherein the spray of liquid droplets has a mean droplet diameter of greater than about 20 $\mu$m.

5. A process as set forth in claim 1 further comprising controlling reentrainment of the draining liquid and captured particles in the clean gas stream, the process further comprising passing the clean gas stream through reentrainment control means disposed downstream of the filter media relative to the direction of gas flow through the filter element.

6. A process as set forth in claim 1 wherein the electric potential is applied to the filter media by connecting the filter media to a direct current power supply.

7. A process as set forth in claim 6 wherein the electric potential is applied to the filter media continuously.

8. A process as set forth in claim 7 wherein the electric potential applied to the filter media is substantially maintained at a magnitude just below that which would result in spark over between the filter element and the ground electrode at the prevailing operating conditions.

9. A process as set forth in claim 6 wherein the electric potential is applied to the filter media intermittently.

10. A process as set forth in claim 6 wherein the magnitude of the electric potential applied to the filter media is at least about 10 kv.

11. A process as set forth in claim 10 wherein the magnitude of the electric potential applied to the filter media is from at least about 10 kv to about 70 kv.

12. A process as set forth in claim 11 wherein the limited current discharge between the electrostatically charged filter media and the ground electrode per unit of gas flow area of the filter element is no greater than about 10 mA/m$^2$.

13. A process as set forth in claim 1 wherein solid particles are entrained in the gas to be treated, solid particles captured within the wetted filter media and the liquid wetting the filter media forming a suspension having a zeta potential characterized by a charge of the same polarity attached to the surface of a predominant number of captured solid particles within the suspension, the polarity of the electric potential applied to the filter media being selected such that the filter media has a charge of the same polarity as the zeta potential of the suspension, captured solid particles in the suspension thereby being repulsed from the filter media by electrophoresis to enhance removal of captured solid particles from the wetted filter media by the draining liquid.

14. A process for treating a gas stream to remove solid particles entrained in the gas stream, the process comprising:

providing a substantially electrically isolated, gas-permeable filter element comprising electrically conductive filter media wetted with a liquid;

electrostatically charging the wetted filter media by applying an electric potential to the filter media with respect to ground;

passing the gas stream containing solid particles through the filter element with a horizontal component of movement, the entrained particles thereby being captured in the wetted filter media to produce a clean gas stream from which entrained particles have been removed; and continuously draining the liquid from the wetted filter media under the force of gravity to remove captured particles and produce a liquid waste stream exiting the filter element containing the removed particles, the draining liquid having a horizontal component of movement through the filter media toward the downstream surface of the filter element relative to the direction of gas flow through the filter element imparted by the gas drag force, captured solid particles and the liquid wetting the filter media forming a suspension having a zeta potential characterized by a charge of the same polarity attached to the surface of a predominant number of captured solid particles within the suspension, the polarity of the electric potential applied to the filter media being selected such that the filter media has a charge of the same polarity as the zeta potential of the suspension, captured solid particles in the suspension thereby being repulsed from the filter media by electrophoresis to enhance removal of captured solid particles from the wetted filter media by the draining liquid.

15. A process set forth in claim 14 wherein the suspension contains captured solid particles having a positive charge attached to the surface of the particle and captured solid particles having a negative charge attached to the surface of the particle, the polarity of the electric potential applied to the filter media being periodically switched to cause captured solid particles having a positive charge attached to the surface of the particle and captured solid particles having a negative charge attached to the surface of the particle within the suspension to be alternately repulsed from the filter media.

16. A process set forth in claim 15 wherein the proportion of captured solid particles in the suspension having a positive charge attached to the surface of the particle and the proportion of captured solid particles in the suspension having a negative charge attached to the surface of the particle is from about 30 percent to about 70 percent.

17. A process as set forth in claim 16 wherein the period during which the charge on the filter media is of a selected polarity is proportional to the fraction of captured solid particles in the suspension having a charge of the same polarity attached to the surface of the particle.

18. An apparatus for treating a gas stream to remove solid or liquid particles entrained in the gas stream and produce a clean gas stream from which particles have been removed and a liquid waste containing particles removed from the gas stream, the apparatus comprising:

a housing having an inlet for introducing the gas stream into the housing, an outlet for discharging the clean gas stream from the housing and a liquid drain port for removing the liquid waste from the housing;

a substantially electrically isolated, gas-permeable filter element comprising electrically conductive filter media wetted by a liquid, the filter element being disposed and oriented within the housing such that the gas stream introduced into the housing is forced to pass through the filter element with a horizontal component of movement and liquid continuously drains from the wetted filter media under the force of gravity to remove particles captured in the filter media and produce the liquid waste containing the removed particles exiting the filter element;

a ground electrode disposed within the housing and connected to ground;

a direct current power supply; and means for connecting the direct current power supply to the filter media and the ground electrode such that an electric potential is applied to the filter media with respect to ground to electrostatically charge the filter media.

19. An apparatus as set forth in claim 18 wherein the direct current power supply includes automatic voltage control means, the automatic voltage control means substantially maintaining the electric potential applied to the filter media at a magnitude just below that which would result in spark over between the filter element and the ground electrode at the prevailing operating conditions within the apparatus.

20. An apparatus as set forth in claim 18 wherein the direct current power supply includes control means which allows the polarity of the electric potential applied to the filter media to be selectively reversed without having to disconnect the filter media from the power supply.

21. An apparatus as set forth in claim 18 wherein the liquid wetting the filter media is aqueous, the apparatus further comprising means for contacting the gas stream with a spray of aqueous liquid droplets upstream of the filter element relative to the direction of gas flow.

22. An apparatus as set forth in claim 21 wherein liquid spray contacting means comprises a fogging nozzle in selective fluid communication with a source of liquid.

23. An apparatus as set forth in claim 18 wherein the electrically conductive filter media comprises a material selected from the group consisting of woven metal fibers, non-woven metal fibers, woven fabrics comprising carbon or metal-coated polymeric fibers and co-knit materials comprising a mixture of electrically conductive and electrically insulative fibers.

24. An apparatus as set forth in claim 23 wherein the electrically conductive filter media comprises a non-woven mat of stainless steel fibers comprised of fibers having a diameter ranging from about 40 $\mu$m to about 500 $\mu$m.

25. An apparatus as set forth in claim 24 wherein the void fraction of the electrically conductive filter media is greater than about 80 percent.

26. An apparatus as set forth in claim 23 wherein the electrically conductive filter media comprises a co-knit material comprising metal fibers and polymeric fibers.

27. An apparatus as set forth in claim 18 wherein the filter element further comprises reentrainment control means disposed downstream of the electrically conductive filter media relative to the direction of gas flow through the filter element.

28. An apparatus as set forth in claim 18 wherein the filter element is in the form of a substantially vertical cylinder suspended within the housing, the filter element comprising a cylindrical foraminous support upon which the electrically conductive filter media is supported.

29. An apparatus as set forth in claim 18 wherein the ground electrode is made integral with the housing, the interior surface of the housing serving as the ground electrode.

30. An apparatus as set forth in claim 29 wherein the housing is made from an electrically insulative, corrosion-resistant material and the ground electrode comprises a static dissipative plastic coating on the interior surface of the housing, the static dissipative plastic coating having a resistivity of no more than about $1\times10^4$ ohm·cm.

31. An apparatus for treating a gas stream to remove solid or liquid particles entrained in the gas stream and produce a clean gas stream from which particles have been removed and a liquid waste stream containing particles removed from the gas stream, the apparatus comprising:

a housing in the form of a vertical cylinder having an inlet for introducing the gas stream into the housing, an outlet for discharging the clean gas stream from the housing and a liquid drain port for removing the liquid waste from the housing;

a substantially electrically isolated, gas-permeable filter element and seal leg combination suspended within the housing, the gas-permeable filter element in the form of a substantially vertical cylinder and comprising electrically conductive filter media wetted by a liquid and supported upon a cylindrical foraminous support, the filter element being disposed and oriented within the housing such that the gas stream introduced into the housing is forced to pass through the filter element with a horizontal component of movement to remove particles entrained in the gas stream and produce the clean gas stream and liquid continuously drains from the wetted filter media under the force of gravity to remove particles captured in the filter media and produce the liquid waste stream containing the removed particles, the seal leg comprising a liquid drain conduit and seal leg cup, the liquid waste stream being removed from the filter element through the liquid drain conduit and collecting in the seal leg cup to provide a liquid seal in the liquid drain conduit and prevent the gas stream introduced into the housing from bypassing the filter media;

means for contacting the gas stream with a spray of liquid droplets upstream of the filter element relative to the direction of gas flow;

a ground electrode connected to ground, the ground electrode made integral with the housing, the interior surface of the housing serving as the ground electrode;

a direct current power supply; and means for connecting the direct current power supply to the filter media and the ground electrode such that an electric potential is applied to the filter media with respect to ground to electrostatically charge the filter media.

32. An apparatus as set forth in claim 31 further comprising a clean gas conduit, the outlet of the housing being in fluid communication with the interior of the filter element through the clean gas conduit, the clean gas conduit being joined to the housing and to the filter element such that the filter element and seal leg combination is suspended within the housing from the clean gas conduit, the clean gas conduit and filter element being in coaxial relationship with the housing such that an annular gap separates the interior surface of the housing from the exterior surface of the clean gas conduit.

33. An apparatus as set forth in claim 32 further comprising means for introducing a purge gas into the annular gap separating the interior surface of the housing from the exterior surface of the clean gas conduit.

34. An apparatus as set forth in claim 31 wherein the housing is made from an electrically insulative, corrosion-resistant material and the ground electrode comprises a static dissipative plastic coating on the interior surface of the housing, the static dissipative plastic coating having a resistivity of no more than about $1\times10^4$ ohm·cm.

35. An apparatus as set forth in claim 31 wherein the means for connecting the direct current power supply to the ground electrode comprises an electrically conductive grounding lug extending into the housing into contact with the ground electrode.

36. An apparatus as set forth in claim 35 wherein a multiplicity of electrically conductive grounding lugs extending into the housing into contact with the ground electrode are uniformly distributed over the surface of the housing.

37. A modular gas cleaning system for treating a gas stream to remove solid or liquid particles entrained in the gas stream and produce a clean gas stream from which particles have been removed and a liquid waste stream containing particles removed from the gas stream, the system comprising:

at least one gas cleaning apparatus module, the module comprising a housing, a substantially electrically isolated gas-permeable filter element and seal leg combination suspended within the housing and a ground electrode, the housing in the form of a vertical cylinder having an inlet for introducing the gas stream into the housing, an outlet for discharging the clean gas stream from the housing and a liquid drain port for removing the liquid waste from the housing, the gas-permeable filter element in the form of a substantially vertical cylinder and comprising electrically conductive filter media wetted by a liquid and supported upon a cylindrical foraminous support, the filter element being disposed and oriented within the housing such that the gas stream introduced into the housing is forced to pass through the filter element with a horizontal component of movement to remove particles entrained in the gas stream and produce the clean gas stream and liquid continuously drains from the wetted filter media under the force of gravity to remove particles captured in the filter media and produce the liquid waste stream containing the removed particles, the seal leg comprising a liquid drain conduit and seal leg cup, the liquid waste stream being removed from the filter element through the liquid drain conduit and collecting in the seal leg cup to provide a liquid seal in the liquid drain conduit and prevent the gas stream introduced into the housing from bypassing the filter media, the ground electrode connected to ground and being made integral with the housing, the interior surface of the housing serving as the ground electrode;

means for contacting the gas stream with a spray of liquid droplets upstream of the filter element relative to the direction of gas flow;

a direct current power supply;

means for connecting the direct current power supply to the filter media and the ground electrode such that an electric potential is applied to the filter media with respect to ground to electrostatically charge the filter media; and an intake manifold and a clean gas manifold adapted for connection to at least one module, the intake manifold and the clean gas manifold being connected to the module such that the intake manifold and the clean gas manifold are in fluid communication through the module, the gas stream being introduced into the intake manifold and passed through the module, the clean gas stream from the module being discharged from the system through the clean gas manifold, the intake manifold serving as a sump for collecting liquid waste draining from the module.

38. A system as set forth in claim 37 wherein the intake manifold and the clean gas manifold are adapted for connection to a variable number of modules such that the system is capable of accommodating varying gas flow capacity demands, the system comprising at least two modules, the intake manifold and the clean gas manifold being connected to the modules such that the intake manifold and the clean gas manifold are in fluid communication through the modules, the gas stream being introduced into the intake manifold and distributed between the modules by the intake manifold and the clean gas stream from the modules being collected in the clean gas manifold and discharged from the system, the intake manifold serving as a universal sump for collecting liquid waste draining from the modules, the filter media within the modules being connected to the direct current power supply in parallel.

39. A system as set forth in claim 38 wherein the electrical connection between the filter media in the modules passes through the intake manifold.

40. A process for treating a gas stream to remove solid or liquid particles entrained in the gas stream, the process comprising:

providing a substantially electrically isolated, gas-permeable filter element comprising electrically conductive filter media wetted with a liquid;

electrostatically charging the wetted filter media by applying an electric potential to the filter media with respect to ground;

passing the gas stream to be treated through an electric field imposed by a limited current discharge between the electrostatically charged filter media and a ground electrode to induce a charge on particles entrained in the gas having a polarity opposite of the charge on the filter media;

passing the gas stream containing charged particles through the filter element with a horizontal component of movement, the entrained particles thereby being captured in the wetted filter media to produce a clean gas stream from which entrained particles have been removed;

continuously draining the liquid from the wetted filter media under the force of gravity to remove captured particles and produce a liquid waste containing the removed particles exiting the filter element, the draining liquid having a horizontal component of movement through the filter media toward the downstream surface of the filter element relative to the direction of gas flow through the filter element imparted by the gas drag force; and maintaining discontinuity in the flow of liquid waste exiting the filter element.

41. An apparatus for treating a gas stream to remove solid or liquid particles entrained in the gas stream and produce a clean gas stream from which particles have been removed and a liquid waste containing particles removed from the gas stream, the apparatus comprising:

a housing having an inlet for introducing the gas stream into the housing, an outlet for discharging the clean gas stream from the housing and a liquid drain port for removing the liquid waste from the housing;

a substantially electrically isolated, gas-permeable filter element comprising electrically conductive filter media wetted by a liquid, the filter element being disposed and oriented within the housing such that the gas stream introduced into the housing is forced to pass through the filter element with a horizontal component of movement and liquid continuously drains from the wetted filter media under the force of gravity to remove particles captured in the filter media and produce the liquid waste containing the removed particles exiting the filter element, the apparatus being adapted to maintain discontinuity in the flow of liquid waste exiting the filter element;

a ground electrode disposed within the housing and connected to ground;

a direct current power supply; and means for connecting the direct current power supply to the filter media and the ground electrode such that an electric potential is applied to the filter media with respect to ground to electrostatically charge the filter media.

* * * * *